US010810982B2

(12) United States Patent
Hiraiwa

(10) Patent No.: US 10,810,982 B2
(45) Date of Patent: Oct. 20, 2020

(54) ELECTRONIC MUSICAL INSTRUMENT AND MUSICAL SOUND GENERATION PROCESSING METHOD OF ELECTRONIC MUSICAL INSTRUMENT

(71) Applicant: Roland Corporation, Shizuoka (JP)

(72) Inventor: Yoshifumi Hiraiwa, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 16/566,911

(22) Filed: Sep. 11, 2019

(65) Prior Publication Data

US 2020/0082801 A1 Mar. 12, 2020

(30) Foreign Application Priority Data

Sep. 12, 2018 (JP) ..... 2018-170745

(51) Int. Cl.
*G10H 1/055* (2006.01)
*G10H 1/00* (2006.01)
*G10H 1/34* (2006.01)

(52) U.S. Cl.
CPC ..... *G10H 1/055* (2013.01); *G10H 1/0008* (2013.01); *G10H 1/344* (2013.01); *G10H 2210/155* (2013.01); *G10H 2220/221* (2013.01); *G10H 2220/461* (2013.01)

(58) Field of Classification Search
CPC ..... G10H 1/055; G10H 1/0008; G10H 1/344; G10H 2220/221; G10H 2220/461; G10H 2210/155
USPC ..... 84/609
See application file for complete search history.

(56) References Cited

U.S. PATENT DOCUMENTS 5,561,257 A * 10/1996 Cardey, III ..... G10H 1/0058 84/626
6,018,118 A 1/2000 Smith et al.
8,426,719 B2 * 4/2013 Shim ..... G10H 1/34 84/743
9,799,316 B1 * 10/2017 Owens ..... G10H 1/46
10,157,602 B2 * 12/2018 Hanks ..... G10H 1/20
10,621,963 B2 * 4/2020 Starr ..... G10H 1/0008
(Continued)

FOREIGN PATENT DOCUMENTS

JP H078896 2/1995
JP H08297489 11/1996
(Continued)

OTHER PUBLICATIONS

"Search Report of Europe Counterpart Application", dated Jan. 2, 2020, p. 1-p. 8.

*Primary Examiner* — Jeffrey Donels
(74) *Attorney, Agent, or Firm* — JCIPRNET

(57) ABSTRACT

An keytar (1) includes a keyboard (2) on which a plurality of keys (2*a*) are arranged, a ribbon (5) in which a front surface panel (81) is arranged, and the degree of the same type of musical sound effect applied to each of tones (A-D) produced by the key (2*a*) is changed corresponding to detection positions in an X-direction in the front surface panel (81). Accordingly, because the degrees of the musical sound effects can be respectively changed for each of the tones (A-D) corresponding to the detection positions in the X-direction of the front surface panel (81), for the change of the same type of musical sound effect toward the tones (A-D), the monotony of this change can be suppressed and an expressive performance can be achieved.

18 Claims, 15 Drawing Sheets

(56) References Cited

U.S. PATENT DOCUMENTS

| | | | | |
|---|---|---|---|---|
| 2003/0188627 | A1 | 10/2003 | Longo | |
| 2012/0297962 | A1* | 11/2012 | O'Donnell | G10H 1/34 84/645 |
| 2013/0255474 | A1* | 10/2013 | Hanks | G10H 1/0016 84/615 |
| 2016/0163298 | A1 | 6/2016 | Butera | |
| 2019/0066645 | A1* | 2/2019 | Abadi | G10H 1/0091 |

FOREIGN PATENT DOCUMENTS

| | | |
|---|---|---|
| JP | H10124055 | 5/1998 |
| JP | H10319961 | 12/1998 |
| JP | 2002351468 | 12/2002 |
| JP | 2017122824 | 7/2017 |
| WO | 2005096133 | 10/2005 |
| WO | 2018136829 | 7/2018 |

* cited by examiner

X-direction aspect information table 11b

| tone number | aspect level 1 | aspect level 2 | ・・・ |
|---|---|---|---|
| 4 | L 1 4 | L 2 4 | ・・・ |
| 3 | L 1 3 | L 2 3 | ・・・ |
| 2 | L 1 2 | L 2 2 | ・・・ |

FIG.12(a)

aspect information L14

| input value | tone A | tone B | tone C | tone D |
|---|---|---|---|---|
| 0 | 127 | 0 | 0 | 0 |
| 1 | 127 | 3 | 0 | 0 |
| 2 | 127 | 6 | 0 | 0 |
| : | : | : | : | : |
| 40 | 127 | 124 | 0 | 0 |
| 41 | 127 | 127 | 3 | 0 |
| : | : | : | : | : |
| 80 | 127 | 127 | 124 | 0 |
| 81 | 127 | 127 | 127 | 3 |
| : | : | : | : | : |
| 127 | 127 | 127 | 127 | 127 |

FIG.12(b)

YZ-direction aspect information table 11c

| sound production number | aspect information |
|---|---|
| 4 | L 4 |
| 3 | L 3 |
| 2 | L 2 |

FIG.12(c)

aspect information L4

| input value | tone A | tone B | tone C | tone D |
|---|---|---|---|---|
| 0 | 0 | 0 | 0 | 0 |
| 1 | 1 | 1 | 1 | 1 |
| 2 | 2 | 2 | 2 | 2 |
| : | : | : | : | : |
| 80 | 80 | 80 | 80 | 80 |
| 81 | 81 | 81 | 81 | 81 |
| : | : | : | : | : |
| 127 | 127 | 127 | 127 | 127 |

FIG.12(d)

ELECTRONIC MUSICAL INSTRUMENT AND MUSICAL SOUND GENERATION PROCESSING METHOD OF ELECTRONIC MUSICAL INSTRUMENT

CROSS-REFERENCE TO RELATED APPLICATION

This application claims the priority benefit of Japan Patent Application No. 2018-170745, filed on Sep. 12, 2018. The entirety of the above-mentioned patent application is hereby incorporated by reference herein and made a part of this specification.

BACKGROUND OF THE DISCLOSURE

Technical Field

The disclosure relates to an electronic musical instrument and a musical sound generation processing method of the electronic musical instrument.

Related Art

In patent literature 1, a technology of an electronic musical instrument is disclosed in which the electronic musical instrument includes a keyboard device KY for instructing an occurrence start and stop of a musical sound and a ribbon controller RC for detecting a detection position on a detection surface, and applies the degree of one musical sound effect (cut-off, resonance or the like) corresponding to the detection position of the ribbon controller RC to each of a plurality of tones constituting the musical sound and outputs the tones. Accordingly, the degree of one musical sound effect desired by a user can be easily changed according to the detection positions of the ribbon controller RC.

LITERATURE OF RELATED ART

Patent Literature

[Patent literature 1] Japanese Laid-Open No. 2017-122824

However, the change of the degree of one musical sound effect corresponding to the detection position of the ribbon controller RC is the same in all of the plurality of tones. Accordingly, there is a risk that because the degrees of the musical sound effects with respect to all of the plurality of tones are all changed in the same way even if the user frequently changes the detection position of the ribbon controller RC during performance, the change of the musical sound effect that is output eventually and heard by audience sounds monotonous.

The disclosure provides an electronic musical instrument capable of changing the degrees of musical sound effects with respect to a plurality of tones, suppressing the monotony of this change and performing expressively.

SUMMARY

The electronic musical instrument of the disclosure includes: an input unit, which inputs a pronunciation indication of a plurality of tones; a detection unit, which has a detection surface and detects detection positions on the detection surface; a musical sound control unit, which applies a musical sound effect to each of the plurality of tones based on the pronunciation indication input by the input unit and outputs the tones; and a musical sound effect change unit, which changes, for each tone, a degree of the musical sound effect applied to each tone by the musical sound control unit corresponding to the detection positions detected by the detection unit.

BRIEF DESCRIPTION OF THE DRAWINGS

FIG. 2(*b*) is a cross-sectional view of the neck in a case of loading pressure on the ribbon controller or a case of operating a modulation bar; and FIG. 2(*c*) is a front view of the neck in a case of operating the modulation bar.

FIG. 3(*b*) is a plan view of a terminal portion in the ribbon controller.

FIG. 8(*b*) is an illustration diagram for illustrating a detection principle.

FIG. 9(*b*) is an illustration diagram showing an example of a resistance-load (pressure) characteristic in the pressure sensitive sensor.

FIG. 12(*a*) is a diagram schematically showing an X-direction aspect information table;

FIG. 12(*b*) is a diagram schematically showing aspect information stored in the X-direction aspect information table;

FIG. 12(*c*) is a diagram schematically showing a YZ-direction aspect information table; and FIG. 12(*d*) is a diagram schematically showing aspect information stored in the YZ-direction aspect information table.

DESCRIPTION OF THE EMBODIMENTS

Figure 1:
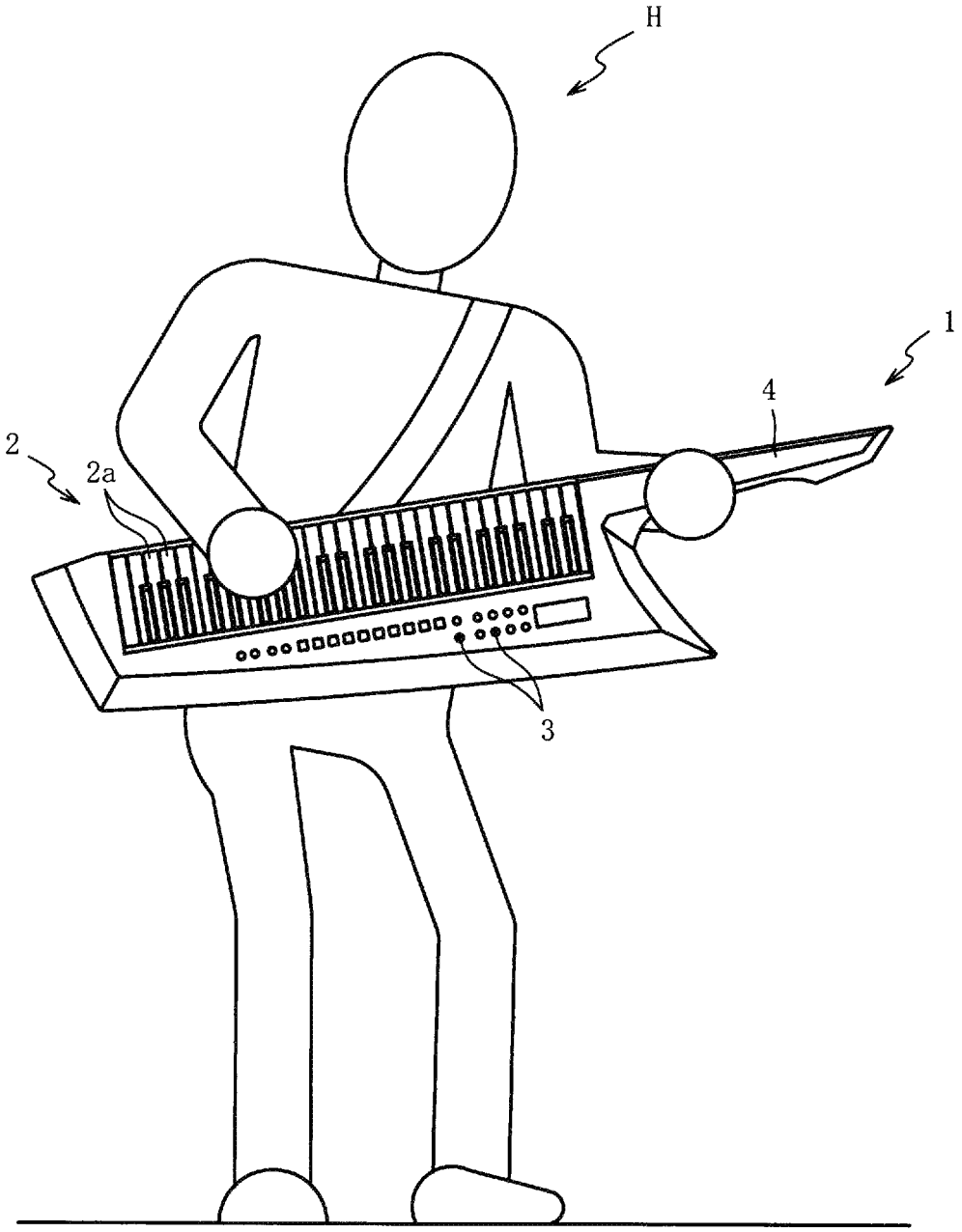
FIG. 1 is an external view of a keytar that is an embodiment.

In the following, preferred examples are described with reference to the attached diagrams. FIG. 1 is an external view of a keytar 1 that is an embodiment. The keytar 1 is an electronic musical instrument, which applies a musical sound effect such as a volume change or a pitch change, a cut-off or a resonance to each of a plurality of tones that is based on a performance operation of a performer H and outputs the tone. The term "keytar" refers to an electronic keyboard or synthesizer that can be operated in a performance style like a guitar by hanging it on the neck or shoulder using a strap or the like. Especially in Japan, it is sometimes called "shoulder keyboard".

As shown in FIG. 1, a keyboard 2 and setting keys 3 which change various setting contents of the keytar 1 are arranged on the keytar 1. The keyboard 2 is an input device for acquiring performance information of a performance of the performer H and is equipped with a plurality of keys 2*a*. The performance information of a MIDI (Musical Instrument Digital Interfaces) standard corresponding to a plurality of tones according to a key pressing/key releasing operation of the keys 2*a* done by the performer H is output to a CPU 10 (see FIG. 11). The setting keys 3 are keys which change various settings of the keytar 1, for example, tones assigned to the keys 2*a*, musical sound effects assigned to a ribbon controller 5 and a modulation bar 6 described later in FIG. 2(*a*)-FIG. 2(*c*), or the like.

In a position adjacent to the keyboard 2, a neck 4 which becomes a handle of the performer H in the keytar 1 is formed. By grasping the neck 4 with a hand (the left hand of the performer H in FIG. 1) that does not operate the keyboard 2 in the performer H, a balance of the keytar 1 during the operation of the keyboard 2 can be stabilized. In addition, the degrees of the musical sound effects with respect to a plurality of tones in output can be changed by the ribbon controller 5 and the modulation bar 6 arranged in the neck 4, and the details are described later in FIG. 2(*a*)-FIG. 2(*c*).

Figure 2A:
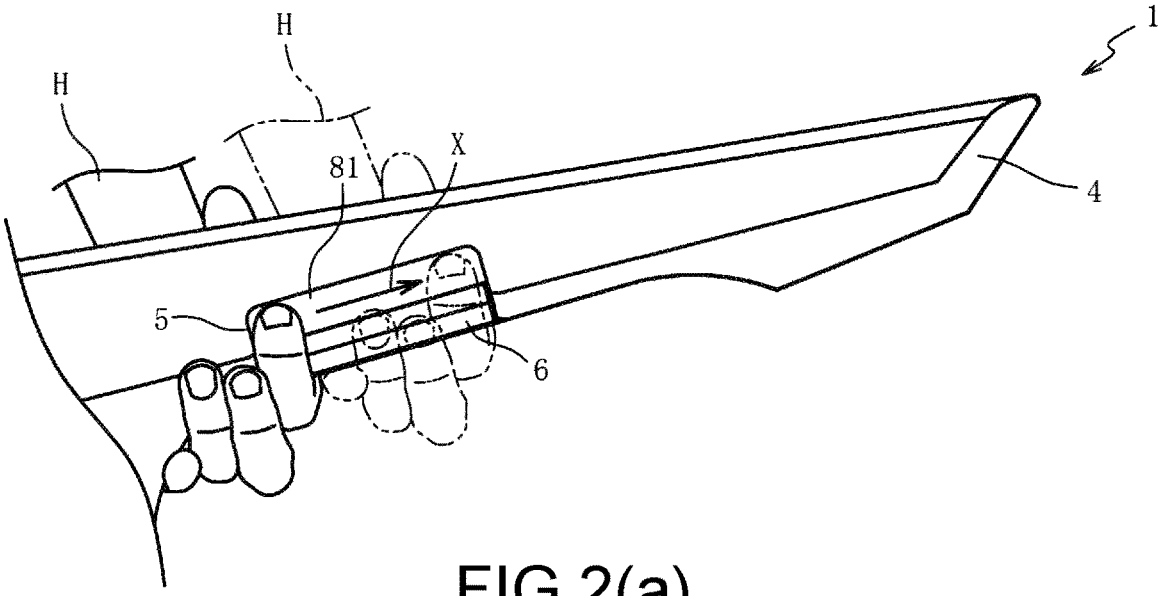
FIG. 2(*a*) is a front view of a neck of the keytar in a case of operating a ribbon controller.
Figure 2B:
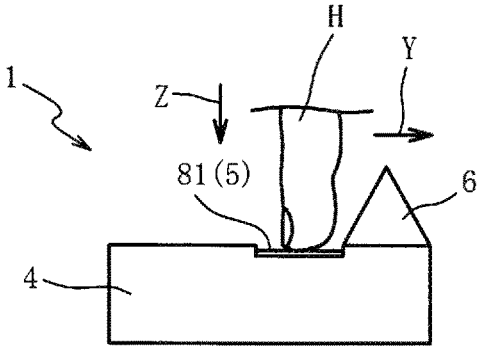
Figure 2C:
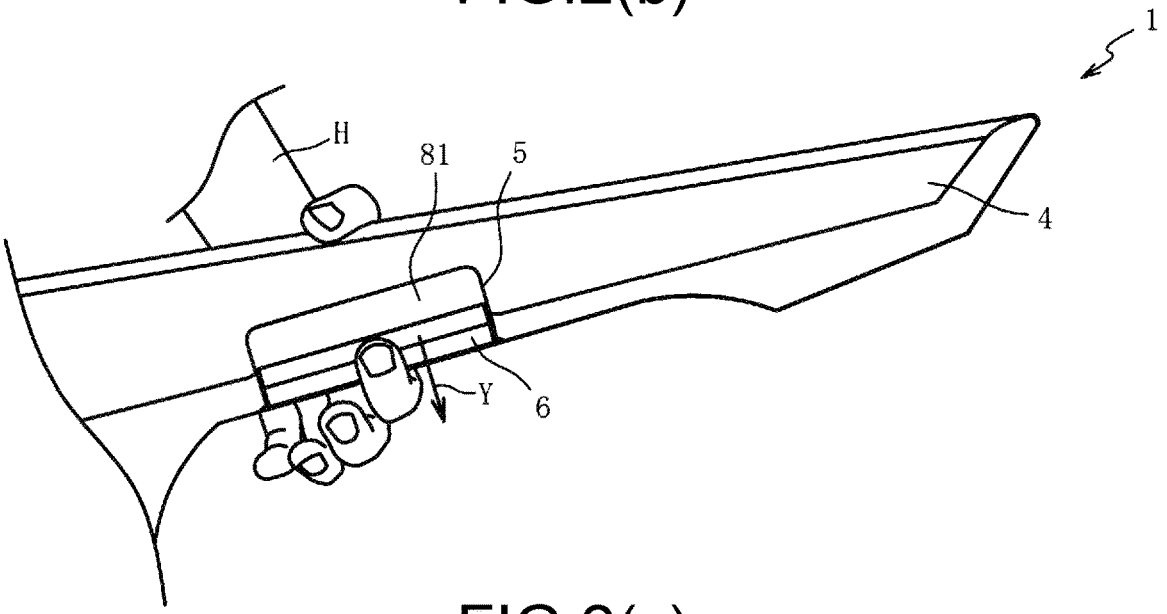

Next, the ribbon controller 5 and the modulation bar 6 arranged in the neck 4 are described with reference to FIG. 2(*a*)-FIG. 2(*c*) to FIG. 9(*a*)-FIG. 9(*b*). FIG. 2(*a*) is a front view of the neck 4 of the keytar 1 in a case of operating the ribbon controller 5; FIG. 2(*b*) is a cross-sectional view of the neck 4 in a case of loading pressure on the ribbon controller 5 or a case of operating the modulation bar 6; and FIG. 2(*c*) is a front view of the neck 4 in a case of operating the modulation bar 6.

As shown in FIG. 2(*a*)-FIG. 2(*c*), the ribbon controller (hereinafter abbreviated as "ribbon") 5 and the modulation bar (hereinafter abbreviated as "operation bar") 6 are arranged in the neck 4. The ribbon 5 is a senor having a rectangular shape in a top view in which a position sensor and a pressure sensitive sensor are laminated. A front surface panel 81 which is a detection surface of the ribbon 5 is arranged in an upper portion of the position sensor and the pressure sensitive sensor in the ribbon 5, a position of the longitudinal side on the front surface panel 81 is detected by the position sensor, and a pressing force on the front surface panel 81 is detected by the pressure sensitive sensor; the details are described later in FIG. 3(*a*)-FIG. 3(*b*) to FIG. 9(*a*)-FIG. 9(*b*). In the following, the longitudinal direction of the front surface panel 81 is referred to as "X-direction" (FIG. 2(*a*)), and the direction in which the pressing force is loaded on the front surface panel 81 is referred to as "Z-direction" (FIG. 2(*b*)). That is, two different types of values of the position in the X-direction and the pressing force in the Z-direction can be acquired by one ribbon 5. Herein, a structure of the ribbon 5 is described with reference to FIG. 3(*a*)-FIG. 3(*b*) to FIG. 9(*a*)-FIG. 9(*b*).

Figure 3B:
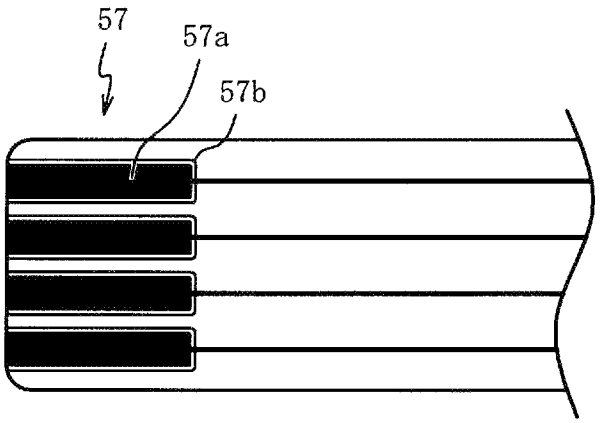
FIG. 3(*a*) is a cross-sectional view showing the ribbon controller.
Figure 3A:
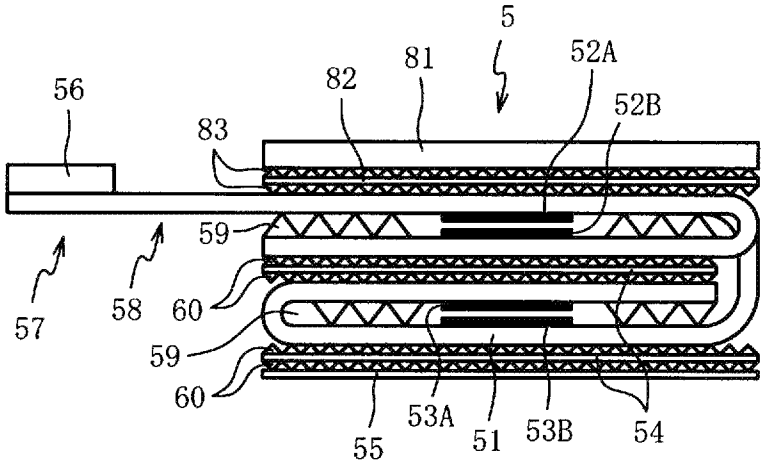

FIG. 3(*a*) is a cross-sectional view showing the ribbon 5; and FIG. 3(*b*) is a plan view of a terminal portion in the ribbon 5.

The ribbon 5 has a structure in which the position sensor and the pressure sensitive sensor are formed in a part of a folded sheet (a film) 51. In this embodiment, resistance membranes 52A, 52B which function as the position sensor are formed. In addition, membranes 53A, 53B made of pressure sensitive conductive ink (hereinafter referred to as pressure sensitive ink) which function as the pressure sensitive sensor are formed.

The film 51 includes four parts (a first part, a second part, a third part, and a fourth part). In a state that the film 51 is folded, the four parts are laminated.

As described hereinafter, a surface on which the resistance membrane 52A in the first part (corresponding to a part 51A shown in FIG. 4) of the film 51 is formed and a surface on which the resistance membrane 52B in the second part (corresponding to a part 51B shown in FIG. 4) of the film 51 is formed are adhered by a pressure sensitive adhesive (a printing paste) 59. A surface on which the membrane 53A in the third part (corresponding to a part 51C shown in FIG. 4) of the film 51 is formed and a surface on which the membrane 53B in the fourth part (corresponding to a part 51D shown in FIG. 4) of the film 51 is formed are also adhered by the pressure sensitive adhesive 59. Besides, in each part, the surface on which the resistance membranes 52A, 52B or the membranes 53A, 53B are formed is set as a front surface. The surface on which the resistance membranes 52A, 52B or the membranes 53A, 53B are not formed is set as a rear surface.

The rear surface of the second part and the rear surface of the third part are adhered by a double-face tape (a double-face adhesive tape). In regard to the double-face tape, an adhesive 60 is laminated on a front surface and a rear surface of a support (a setting plate) 54. Besides, in FIG. 3(*a*), a separating member (a separator) 55 of the double-face tape of the rear side of the third part is also shown.

A terminal portion 57 is formed at one end of the film 51 (see FIG. 3(*b*)). A reinforcement plate 56 is pasted on the rear side of the terminal portion 57 in the film 51. There is an extension portion 58 between a part in which the reinforcement plate 56 and the terminal portion 57 are formed and a part in which the position sensor and the pressure sensitive sensor are formed.

As shown in FIG. 3(*b*), the terminal portion 57 includes four terminals (1)-(4). In each of the terminals (1)-(4), a pressure sensitive ink 57*a* is superimposed and formed on a silver layer 57*b*. Each of the terminals (1)-(4) is electrically connected to one or more of the resistance membranes 52A, 52B and the membranes 53A, 53B by a drawing line.

The ribbon 5 has a front surface panel 81. The front surface panel 81 is adhered to the laminated film 51 by an adhesive (for example, the double-face tape). FIG. 3(*a*) shows an example of using, as the adhesive, the double-face tape in which an adhesive compound 83 is laminated on a front surface and a rear surface of a support 82. The front surface panel 81 is a member for a finger of the performer H or the like to contact and uses, for example, polycarbonate (PC) sheet such as CARBOGLASS (registered trademark) as a material. However, the material of the front surface panel 81 is not limited to PC sheet.

Figure 4:
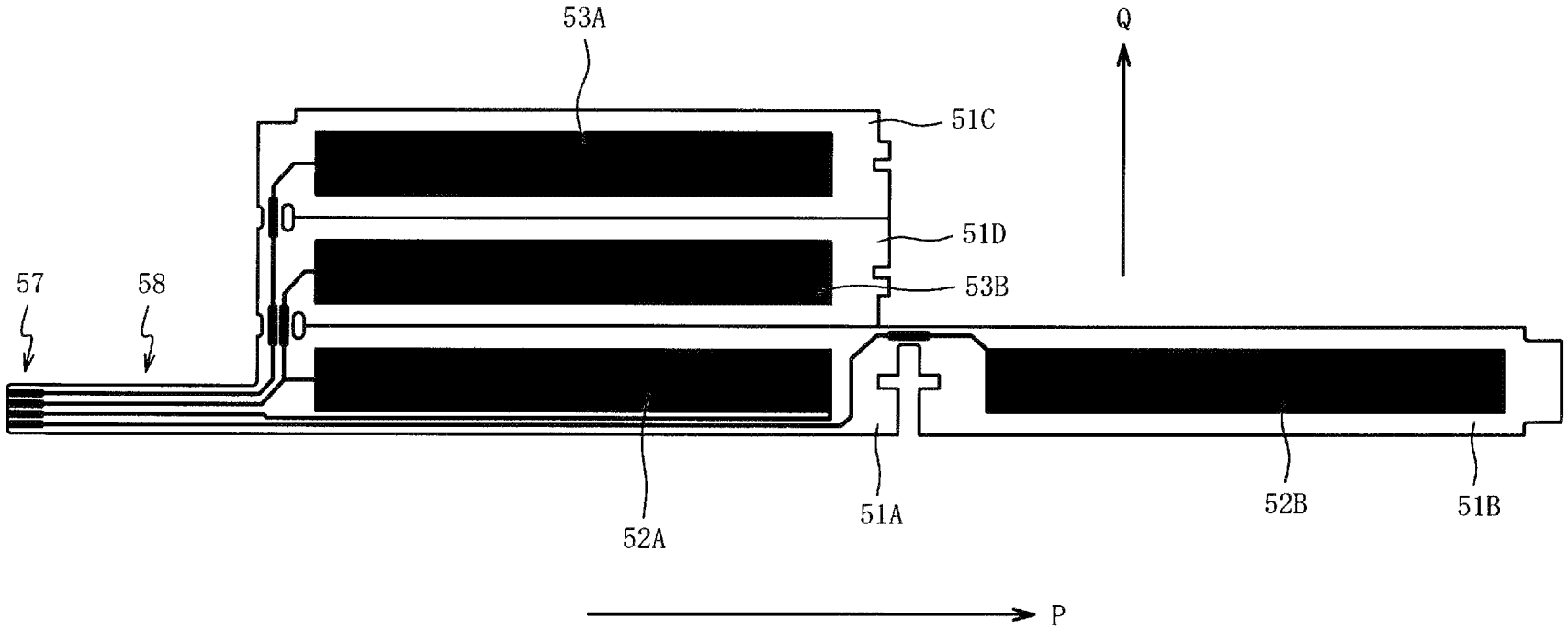
FIG. 4 is a plan view showing an expanded state (a state before a use form is formed) of the ribbon controller.

FIG. 4 is a plan view showing the ribbon 5 before a use form (a folded state) is formed. As shown in FIG. 4, the film 51 includes four parts 51A, 51B, 51C, 51D.

The resistance membrane 52A (see FIG. 3(*a*)) is formed in a part of the front surface of the part 51A closest to the extension portion 58. The resistance membrane 52B (see FIG. 3(*a*)) is formed in a part of the front surface of the part (the part on the right in FIG. 4) 51B adjacent to the part 51A in a P-direction (a longitudinal direction). The membrane 53B (see FIG. 3(*a*)) made of pressure sensitive ink is formed in a part of the front surface of another part (the upper part in FIG. 4) 51D adjacent to the part 51A in a Q-direction (a width direction). The membrane 53A (see FIG. 3(*a*)) made of pressure sensitive ink is formed in a part of the front surface of the part 51C adjacent to the part 51D in the Q-direction. Besides, in the embodiment, the plane shapes of the resistance membranes 52A, 52B and the membranes 53A, 53B are, but not limited to, rectangular shapes. For example, the plane shapes may be ellipse shapes.

In addition, the part 51A and the part 51B can also be seen as being adjacent via a boundary in the width direction (the Q-direction). The part 51A and the part 51D can also be seen as being adjacent via a boundary in the longitudinal direction (the P-direction). The part 51D and the part 51C can also be seen as being adjacent via the boundary in the longitudinal direction (the P-direction).

In addition, in FIG. 4, a line segment between the parts indicates the boundary of the parts. An ellipse on the boundary of the part 51A and the part 51D and an ellipse on the boundary of the part 51C and the part 51D are holes.

The part 51B in the ribbon 5 shown in FIG. 4 before a use form is formed is folded with respect to the part 51A, and the part 51C is folded with respect to the part 51D and further folded with respect to the part 51A; after that, the ribbon 5 includes the part 51A in which the resistance membrane 52A for position detection is formed, the part 51B which is located below the part 51A and in which the resistance membrane 52B for position detection is formed, the part 51C which is located below the part 51B and in which the resistance membrane being pressure sensitive (the membrane 53A) is formed, and the part 51D which is located below the part 51C and in which the resistance membrane being pressure sensitive (the membrane 53B) is formed. Besides, the parts 51A, 51B, 51C, 51D are preferably formed by one base material (the film 51 in the embodiment). Then, for example, the parts are preferably formed by folding one base material. In addition, in the embodiment, "below the part" refers to a lower portion in a position relationship when the position of the front surface panel 81 is regarded as an upper portion.

Figure 5:
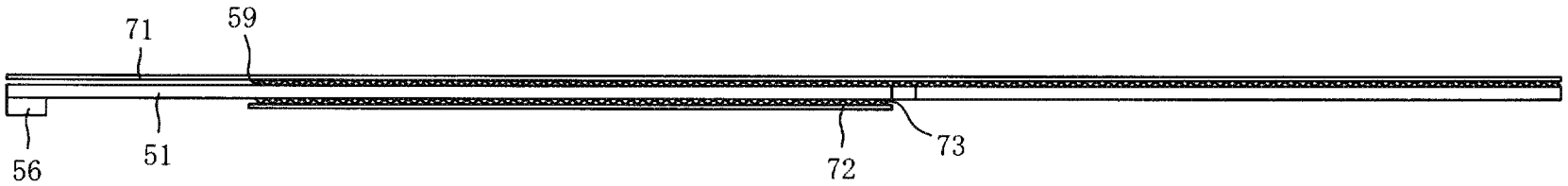
FIG. 5 is a cross-sectional view showing the expanded state (the state before a use form is formed) of the ribbon controller.

FIG. 5 is a cross-sectional view showing the ribbon 5 before a use form is formed. Besides, in FIG. 5, cross sections of the parts 51A, 51B in which the resistance membranes 52A, 52B in FIG. 4 are formed are shown. Accordingly, in FIG. 5, the pressure sensitive adhesive 59 exists on the upper surface side of the film 51. Besides, in the example shown in FIG. 5, a separator 71 is arranged on the upper surface side of the pressure sensitive adhesive 59. In addition, a condition is shown in which the double-face tape including the separator 72 and the adhesive 73 is pasted on the lower surface of a part (specifically, the part 51A) of the film 51.

Next, a formation method of the film 51 is described with reference to FIG. 6(*a*)-FIG. 6(*f*).

Figures 6A, 6B, 6C, 6D, 6E, 6F:
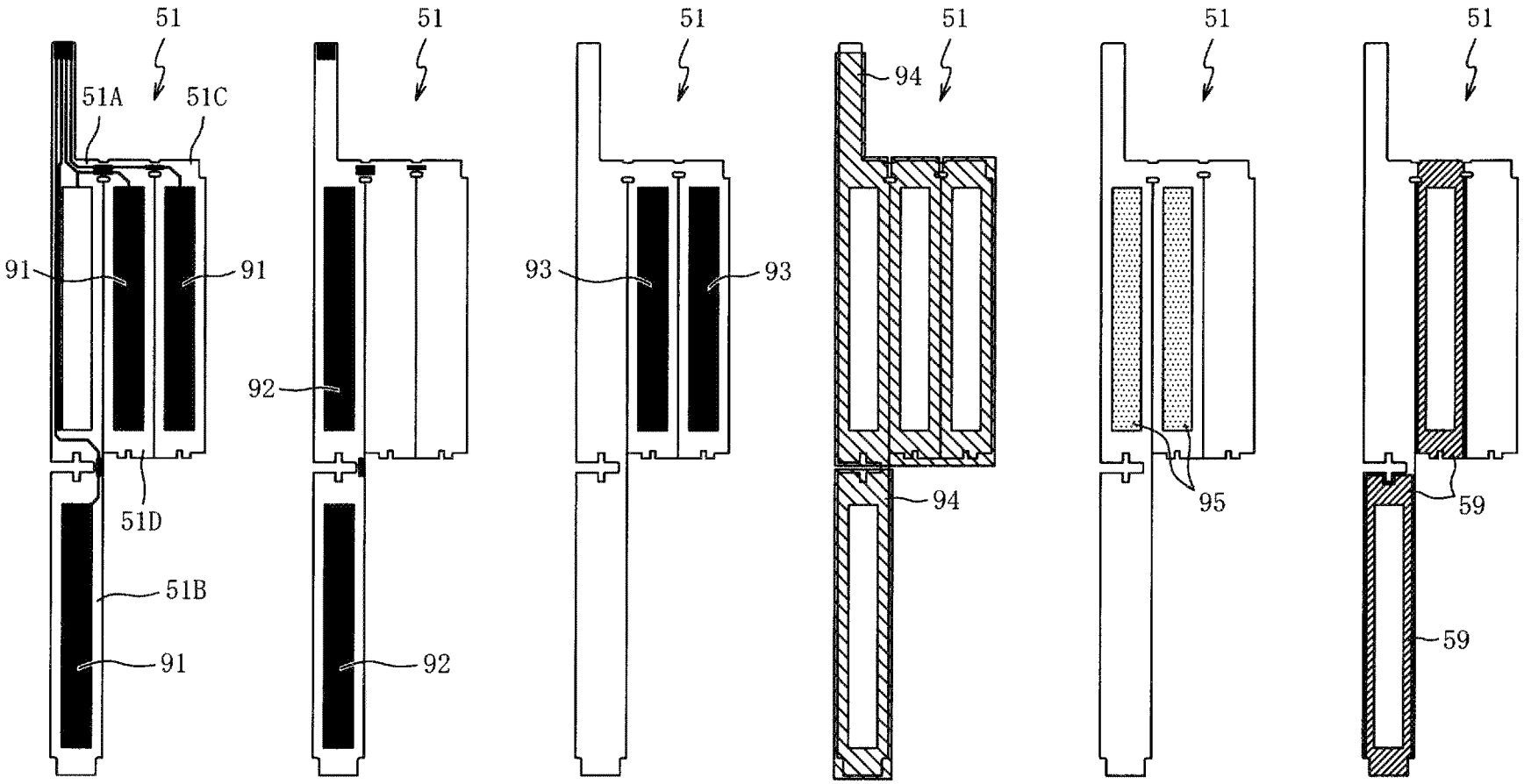
FIG. 6(*a*)-FIG. 6(*f*) are illustration diagrams for illustrating a manufacturing method of the ribbon controller.

FIG. 6(*a*)-FIG. 6(*f*) are illustration diagrams for illustrating a manufacturing method of the ribbon 5. Firstly, a plan film which includes four parts 51A, 51B, 51C, 51D in the film 51 constituting the expanded ribbon 5 and the extension portion 58 (see FIG. 4) is prepared. Besides, the plan film may be a large-area film which includes the film 51 constituting a plurality of ribbons 5. Besides, the film 51 may be polyimide (PI), polyester terephthalate (PET), polyethylene naphthalate (PEN) and the like.

Next, as shown in FIG. 6(*a*), silver is printed (for example, screen printing) to places (see FIG. 4) in which the resistance membrane 52A and the membranes 53A, 53B made of pressure sensitive ink are formed and a place in which a drawing line toward the terminal portion 57 is formed, and a silver layer 91 is formed. Furthermore, as shown in FIG. 6(*b*), a conductive carbon (hereinafter referred to as carbon) 92 is printed (for example, screen printing) to places in the parts 51A, 51B (see FIG. 4) in which the resistance membranes 52A, 52B are formed. At this time, the carbon 92 is also printed to predetermined places in the drawing line. The predetermined places are places in which the parts 51B, 51C, 51D are folded back. Besides, in regard to the part 51B, the carbon 92 is printed onto the place in which the silver is printed so as to protect the silver layer 91.

In addition, as shown in FIG. 6(*c*), the pressure sensitive ink 93 is printed (for example, screen printing) to predetermined places of the parts 51C, 51D. Besides, the predetermined places are places (see FIG. 4) in which the membranes 53A, 53B are formed.

Furthermore, as shown in FIG. 6(*d*), a resist ink 94 is printed (for example, screen printing) to a place other than specified places. Besides, the specified places are the places in the parts 51A, 51B in which the resistance membranes 52A, 52B are formed and the places in the parts 51C, 51D in which the membranes 53A, 53B are formed. In addition, the terminal portion 57 is also included in the specified places.

In addition, as shown in FIG. 6(*e*), by printing (for example, screen printing) a UV curable resin in which spacer particles are dispersed onto the places in the parts 51A, 51D (see FIG. 4) in which the resistance membrane 52A and the membrane 53B are formed, a spacer dots 95 are formed.

In addition, as shown in FIG. 6(*f*), the pressure sensitive adhesive 59 is printed (for example, screen printing) to a place other than the places in the parts 51B, 51D (see FIG. 4) in which the resistance membrane 52B and the membrane 53B are formed. Next, the separator 71 is arranged on the upper surface side of the pressure sensitive adhesive 59 (see FIG. 5). Besides, to simplify the operation, the separator 71 may also be arranged on the upper surface sides of all the parts 51A, 51B, 51C, 51D.

After that, the double-face tape is pasted on the rear surfaces of the parts 51C, 51D. Besides, the double-face tape on the rear surface of the part 51C is used for adhesion with the rear surface of the part 51B. The double-face tape on the rear surface of the part 51D is used for adhesion between the ribbon 5 and other members. In addition, the reinforcement plate 56 is pasted on the rear surface of the terminal portion 57. Then, punching processing is performed to obtain the film 51 in the shape shown in FIG. 4 or the like.

Furthermore, the parts 51B, 51C, 51D are folded in the following procedure for example. The following procedure is described with reference to FIG. 4 to FIG. 6(*a*)-FIG. 6(*f*).

Firstly, the part 51C is bent toward the part 51D side so that a boundary of the part 51C and the part 51D is creased and the membranes 53A, 53B face each other. In addition, the part 51B is bent toward the part 51A side so that a boundary of the part 51A and the part 51B is creased and the resistance membranes 52A, 52B face each other.

After that, the parts 51A, 51B, 51C, 51D are temporarily expanded to return to the state as shown in FIG. 4. In this state, there are creases between the parts.

In this state, the separator 71 (see FIG. 5) on the front surface of the part 51D is peeled. When the separator 71 is arranged in all the parts 51A, 51B, 51C, 51D, the separators 71 on the front surfaces of the parts 51A, 51C, 51D are peeled. Then, the part 51C is folded again toward the part 51D side so that the membranes 53A, 53B face each other.

Because the layer of the pressure sensitive adhesive 59 is formed on the front surface of the part 51D (see FIG. 6(*f*)), the front surface of the part 51C and the front surface of the part 51D are adhered.

Next, the separator 71 (see FIG. 5) on the front surface of the part 51B is peeled. Then, the part 51B is folded again toward the part 51A so that the resistance membranes 52A, 52B face each other. Because the layer of the pressure sensitive adhesive 59 is formed on the front surface of the part 51B (see FIG. 6(*f*)), the front surface of the part 51A and the front surface of the part 51B are adhered.

In addition, the separator 72 of the double-face tape pasted on the rear surface of the part 51C is peeled. Besides, in this state, the part 51B is folded toward the part 51A side, and the part 51C is folded toward the part 51D side. Then, the rear surface of the part 51C and the rear surface of the part 51B are adhered by the double-face tape.

Furthermore, the double-face tape is pasted on the rear surface of the front surface panel 81, and the front surface panel 81 and the part 51A of the film 51 are adhered by the double-face tape.

In this way, the ribbon 5 shown in FIG. 3(*a*)-FIG. 3(*b*) is obtained.

Besides, the processes for bending or folding the four parts (the first part, the second part, the third part, and the fourth part) may be carried out manually or a jig for carrying out the processes may be used.

Figure 7:
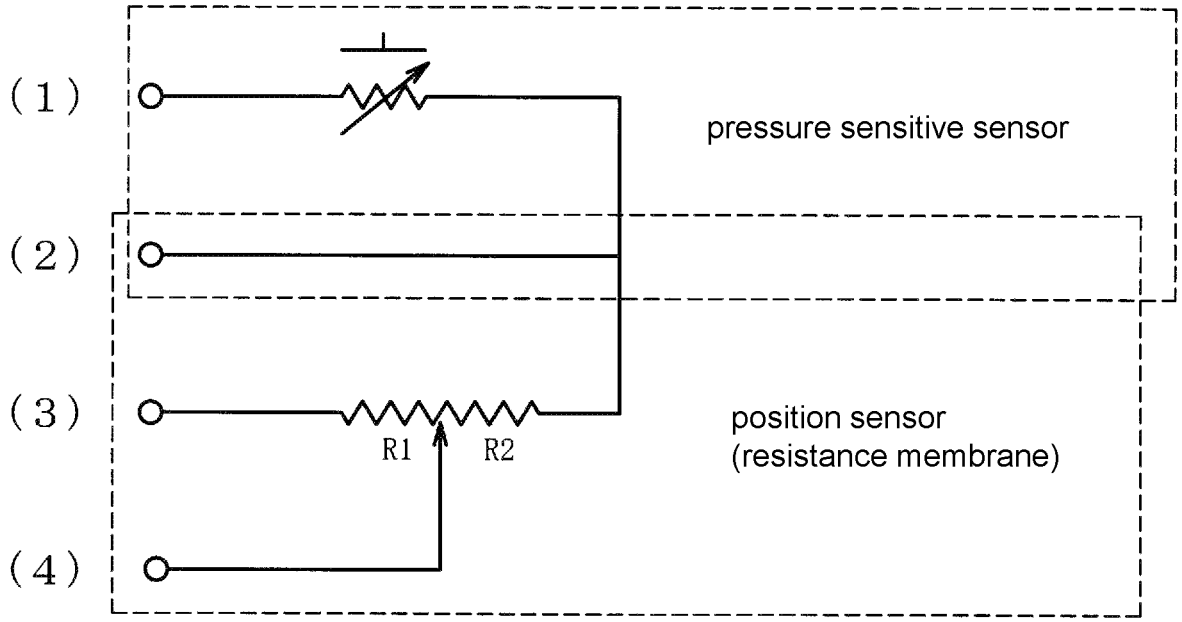
FIG. 7 is a circuit diagram showing schematic circuit configurations of a pressure sensitive sensor and a position sensor.

Next, actions of the position sensor formed on the parts 51A, 51B of the film 51 and the pressure sensitive sensor formed on the parts 51C, 51D of the film 51 are described with reference to FIG. 7 to FIG. 9(*a*)-FIG. 9(*b*). FIG. 7 is a circuit diagram showing schematic circuit configurations of the pressure sensitive sensor and the position sensor. Besides, terminals (1)-(4) in FIG. 7 correspond to the terminals (1)-(4) in FIG. 3(*b*).

Figure 8B:
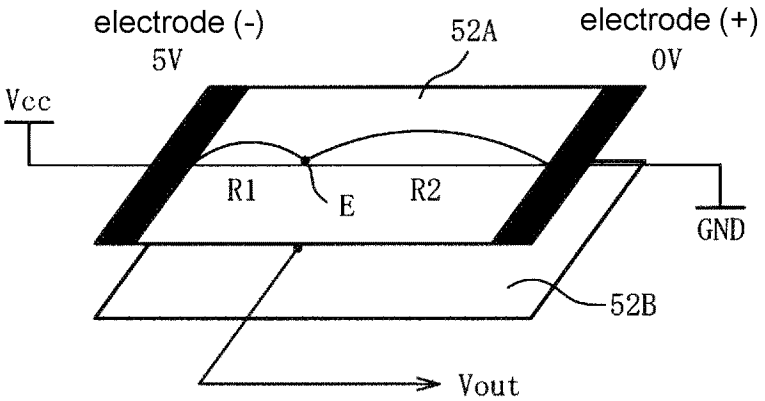
FIG. 8(*a*) is a cross-sectional view for illustrating an action of the position sensor.
Figure 8A:
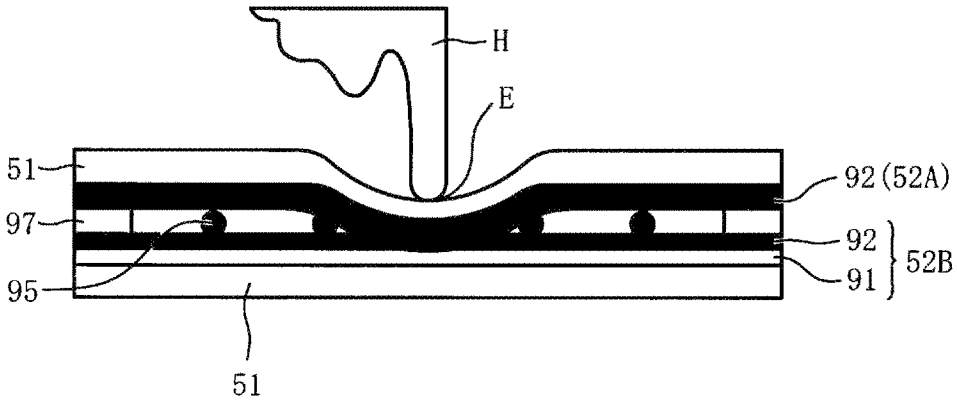

FIG. 8(*a*) is a cross-sectional view for illustrating an action of the position sensor in the ribbon 5. FIG. 8(*b*) is an illustration diagram for illustrating a detection principle.

The film 51 is shown in two places of FIG. 8(*a*), and the upper film 51 corresponds to the part 51A (see FIG. 4 and the like), and the lower film 51 corresponds to the part 51B (see FIG. 4 and the like). In addition, the carbon 92 on the upper side corresponds to the resistance membrane 52A (see FIG. 3(*a*)-FIG. 3(*b*) and the like), and the carbon 92 and the silver layer 91 on the lower side correspond to the resistance membrane 52B (see FIG. 3(*a*)-FIG. 3(*b*) and the like). Besides, in FIG. 8(*a*), the spacer dots 95 and the spacer 97 are also shown. The part of the spacer 97 includes the pressure sensitive adhesive 59 or the resist ink 94.

As shown in FIG. 8(*b*), a power-supply voltage (Vcc) and a ground potential (0 V) are supplied to two sides (black parts in FIG. 8(*b*)) of the resistance membrane 52A. Besides, the power-supply voltage (Vcc) and the ground potential (0 V) are supplied from the terminal (3) and the terminal (2) in FIG. 7. However, the ground potential (0 V) may also be supplied from the terminal (3), and the power-supply voltage (Vcc) may also be supplied from the terminal (2). The place in which the Vcc is supplied is set as a power-supply electrode, and the place in which 0 V is supplied is set as a ground electrode. An output (Vout) is extracted from the drawing line connected to the resistance membrane 52B. Besides, the output is extracted from the terminal (4) in FIG. 7.

The direction orthogonal to the two sides of the resistance membrane 52A is set as a p-direction. As shown in FIG. 8(*a*), the finger of the performer H or the like comes into contact with the ribbon 5. R1 represents a resistance value between the power-supply voltage and a place E in contact with the finger of the performer H or the like. R2 represents a resistance value between the place in contact with the finger of the performer H or the like and the ground electrode.

The ratio of a distance from the place E to the electrodes on two ends is equivalent to the ratio of the resistance values of R1 and R2. Thus, when the resistance membrane 52A comes into contact with the resistance membrane 52B due to the contact of the finger of the performer H or the like in the place E, a voltage corresponding to the position of the p-direction appears as the Vout.

Figure 9B:
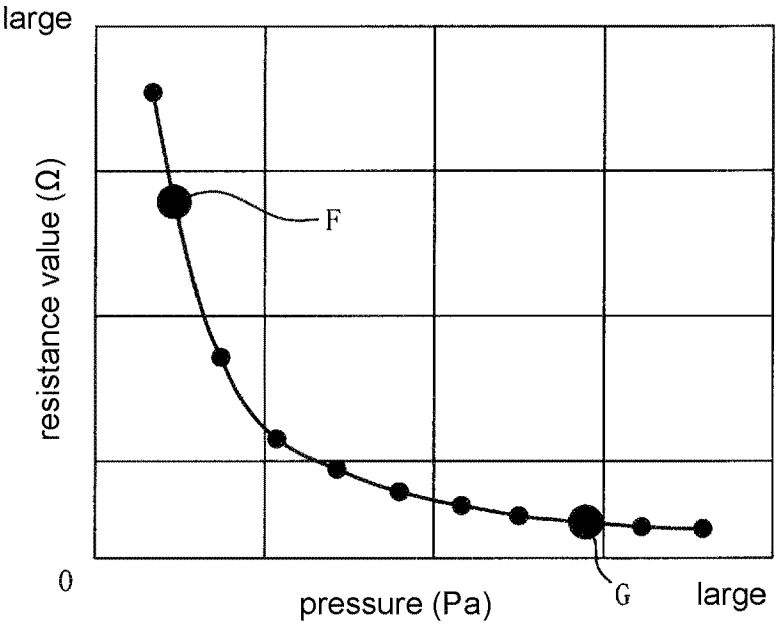
FIG. 9(*a*) is a cross-sectional view for illustrating an action of the pressure sensitive sensor.
Figure 9A:
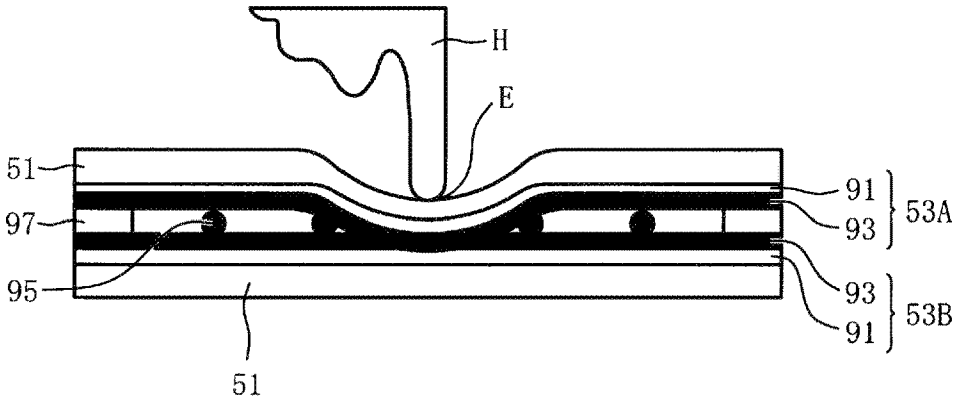

FIG. 9(*a*) is a cross-sectional view for illustrating an action of the pressure sensitive sensor. FIG. 9(*b*) is an illustration diagram showing an example of a resistance-load (pressure) characteristic in the pressure sensitive sensor.

The film 51 is shown in two places of FIG. 9(*a*), the film 51 on the upper side corresponds to the part 51C (see FIG. 4 and the like), and the film 51 on the lower side corresponds to the part 51D (see FIG. 4 and the like). In addition, the silver layer 91 and the pressure sensitive ink 93 on the upper side correspond to the membrane 53A (see FIG. 3(*a*)-FIG. 3(*b*) and the like), and the pressure sensitive ink 93 and the silver layer 91 on the lower side correspond to the membrane 53B (see FIG. 3(*a*)-FIG. 3(*b*) and the like). Besides, in FIG. 9(*a*), the spacer dots 95 and the spacer 97 are also shown. The part of the spacer 97 includes the pressure sensitive adhesive 59 or the resist ink 94.

As shown in FIG. 9(*a*), the finger of the performer H or the like comes into contact with the ribbon 5 in the place E. If the pressing force of the finger of the performer H or the like is large when the membrane 53A and the membrane 53B become a conductive state due to the contact of the finger of the performer H or the like, a contact area of the membrane 53A and the membrane 53B increases and a conductive resistance value is reduced. For example, the ground potential is supplied from the terminal (2) in FIG. 7 to the part 51C, and the output is extracted from the drawing line connected to the membrane 53B. Besides, the output is extracted from the terminal (1) in FIG. 7.

As shown by the resistance-load (pressure) characteristic shown in FIG. 9(*b*), the magnitude of the pressing force is expressed as the magnitude of the resistance value. In FIG. 9(*b*), a black circle F indicates that the pressing force is large and the resistance value detected as the output is small, and a black circle G indicates that the pressing force is small and the resistance value detected as the output is large.

As described above, the ribbon 5 of the embodiment can detect the contact position of the finger of the performer H or the like, namely the detecting position, by the position sensor and can detect the pressing force of the finger of the performer H or the like by the pressure sensitive sensor.

In addition, in the ribbon 5 of the disclosure, one base material (for example, the film 51) includes four parts (the first part, the second part, the third part, and the fourth part, which are, for example, the part 51A, the part 51B, the part 51C, and the part 51D), resistance membranes for position detection (for example, the resistance membranes 52A, 52B) are formed on each of the first part (for example, the part 51) and the second part (for example, the part 51B) which are two adjacent parts in the four parts, and resistance membranes being pressure sensitive (for example, the membranes 53A, 53B made of the pressure sensitive ink 93) are formed in each of the third part (for example, the part 51C) and the fourth part (for example, the part 51D) which are the other two adjacent parts of the four parts; the second part is laminated by being folded with respect to the first part, the third part is laminated by being folded with respect to the fourth part, and the two parts (for example, a laminate of the parts 51A,51B and a laminate of the parts 51C, 51D) formed by folding are interfolded; due to this structure, the amount of components of the ribbon 5 is reduced compared with a case in which the position sensor and the pressure sensitive sensor are separately fabricated. As a result, the ribbon 5 can be manufactured inexpensively. In addition, because one base material is folded and manufactured, assembling of the ribbon 5 becomes simple. For example, when the position sensor and the pressure sensitive sensor are fabricated separately, alignment in high accuracy is required when the position sensor and the pressure sensitive sensor are integrated; in comparison, the alignment is relatively easy in the ribbon 5 of the disclosure. Furthermore, because the position sensor and the pressure sensitive sensor are formed in one member (the film 51), the terminal portion 57 can be aggregated and arranged on the same plane.

In addition, the position sensor and the pressure sensitive sensor can be appropriately applied, by being used in combination, to an electronic musical instrument capable of controlling the strength of sound corresponding to a contact degree of the finger of the performer H or the like.

In addition, in the embodiment, the ribbon 5 is also disclosed which is configured in a manner that in the state before the respective parts are folded, the second part (for example, the part 51B) is adjacent to the first part (for example, the part 51A) in the longitudinal direction of the first part, the fourth part (for example, the part 51D) is adjacent to the first part in the width direction (the direction orthogonal to the longitudinal direction) of the first part, and the third part is adjacent to the fourth part in the longitudinal direction of the fourth part.

In addition, in the embodiment, the ribbon 5 is also disclosed in which the resistance membrane for position detection made of carbon or made of silver and carbon is formed on the first part (for example, the part 51A) and the second part (for example, the part 51B) by screen printing, and the resistance membrane being pressure sensitive made of silver and pressure sensitive ink is formed on the third part (for example, the part 51C) and the fourth part (for example, the part 51D) by screen printing.

In addition, in the embodiment, the ribbon 5 is also disclosed in which the front surface of the first part (for example, the part 51A) and the front surface of the second part (for example, the part 51B) are adhered by the pressure sensitive adhesive, the front surface of the third part (for example, the part 51C) and the front surface of the fourth part (for example, the part 51D) are adhered by the pressure sensitive adhesive, and the rear surface of the second part and the rear surface of the third part are adhered by the double-face adhesive tape.

Return to FIG. 2(*a*)-FIG. 2(*c*). Near the ribbon 5, that is, in the position adjacent to the ribbon 5, an operation bar 6 is arranged. The operation bar 6 is an operator which is arranged along the longitudinal side of the ribbon 5 and outputs an operation amount by operating to recline the operation bar 6 toward the opposite side of the ribbon 5. In the following, the direction of operating the operation bar 6 is referred to as "Y-direction" (FIG. 2(*b*), FIG. 2(*c*)).

Different types of musical sound effects are respectively assigned to the detection positions in the X-direction and the pressing force in the Z-direction detected by the ribbon 5 and the operation amount in the Y-direction detected by the operation bar 6, and the degrees of the musical sound effects are respectively set corresponding to the detection positions in the X-direction, the pressing force in the Z-direction or the operation amount in the Y-direction; the details are described later.

In a conventional keytar, the keyboard and the ribbon controller capable of detecting only the detection positions of the X-direction are also arranged; the performer H performs, on the keytar, a sound instruction by an operation of the right hand on the keyboard and controls the musical sound effect corresponding to the position of the ribbon controller specified by the left hand, and thereby put on a performance as if playing on a guitar. However, since the ribbon controller of the keytar is capable of detecting only the detection positions in the X-direction, the ribbon controller of the keytar cannot change the degree of the musical sound effect even if a pressing force is applied to the ribbon controller in the manner of changing a force of the finger pressing down a guitar string or of strongly pressing the guitar string in a flapping manner with the finger.

On the contrary, in the ribbon 5 of the keytar 1 in the embodiment, a pressing force in the Z-direction can be detected, and the degree of the musical sound effect corresponding to this pressing force in the Z-direction is set. Accordingly, when the pressing force in the Z-direction is applied to the ribbon 5 in the manner of changing the force of the finger pressing down the guitar string or of strongly pressing the guitar string in the flapping manner with the finger, the degree of the musical sound effect can be changed corresponding to the pressing force. That is, the performance of the guitar can be put on more appropriately by the keytar 1.

In addition, because the ribbon 5 and the operation bar 6 are arranged adjacently, three different degrees of musical sound effects can be changed while a hand movement of the performer H is suppressed to the minimum. Furthermore, as shown in FIG. 2(*a*)-FIG. 2(*c*), the X-direction and the Z-direction in the ribbon 5 and the Y-direction in the operation bar 6 are directions orthogonal to each other, and thus the directions for changing the three different types of degrees of musical sound effects, namely, a direction specifying the detection positions in the X-direction, a direction in which the pressing force in the Z-direction is loaded, and a direction indicating the operation amount in the Y-direction are orthogonal to each other. Accordingly, a situation can be prevented in which an undesired type of degree of musical sound effect of the performer H is changed due to operation mistakes of the performer H when setting the three degrees of musical sound effects.

Figure 10:
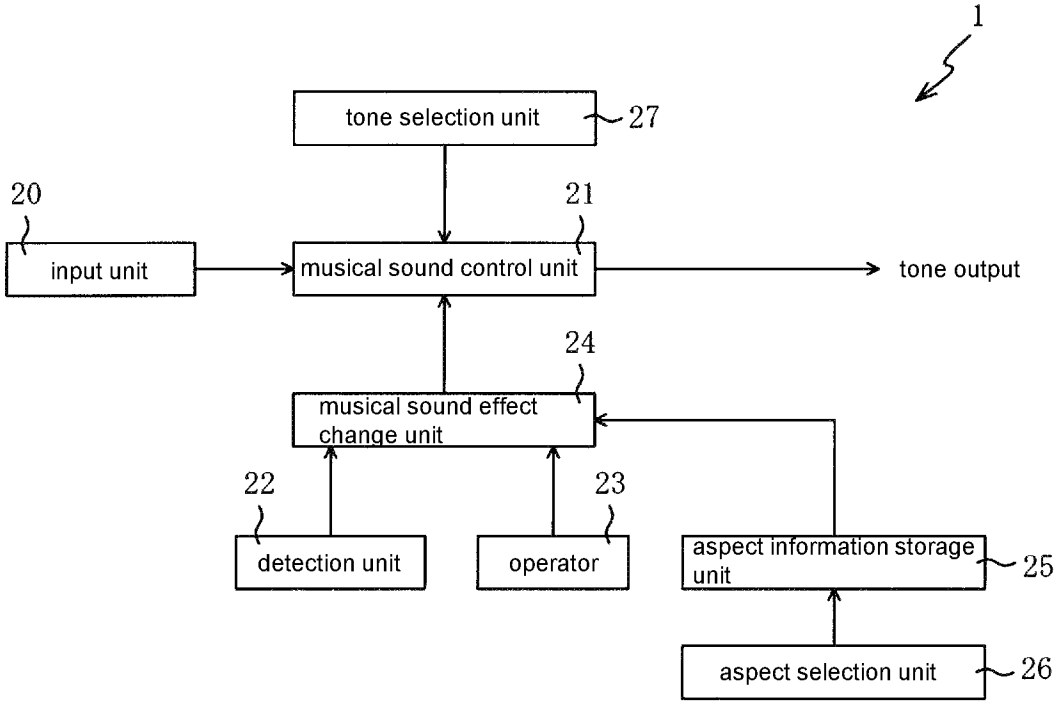
FIG. 10 is a functional block diagram of the keytar.

Next, a function of the keytar 1 is described with reference to FIG. 10. FIG. 10 is a functional block diagram of the keytar 1. As shown in FIG. 10, the keytar 1 has an input unit 20, a musical sound control unit 21, a detection unit 22, an operator 23, a musical sound effect change unit 24, an aspect information storage unit 25, an aspect selection unit 26, and a tone selection unit 27.

The input unit 20 has a function for inputting a sound instruction of a plurality of tones to the keytar 1 by one input from the performer H and is implemented by the keyboard 2 (the keys 2*a*). The musical sound control unit 21 has a function for applying a musical sound effect to each of the plurality of tones that is based on the sound instruction input from the input unit 20 and outputting the tones and is implemented by a CPU 11 described later in FIG. 11.

The detection unit 22 has a detection surface and has a function for detecting the detection positions on the detection surface and the pressing force loaded on the detection surface, and is implemented by the ribbon 5. The operator 23 has a function for inputting the operation from the performer H and is implemented by the operation bar 6. The musical sound effect change unit 24 has a function for changing, for each tone, the degree of the musical sound effect applied to each tone by the musical sound control unit 21 corresponding to the detection positions and the pressing force detected by the detection unit 22 or the operation of the operator 23, and is implemented by the CPU 11. In the embodiment, different types of musical sound effects are respectively assigned to the detection positions and the pressing force of the detection unit 22, or the operation amount of the operator 23 in advance, and the musical sound effect change unit 24 changes, for each tone, the degrees of the musical sound effects respectively assigned corresponding to the detection positions and the pressing force of the detection unit 22, or the operation amount of the operator 23.

Figure 11:
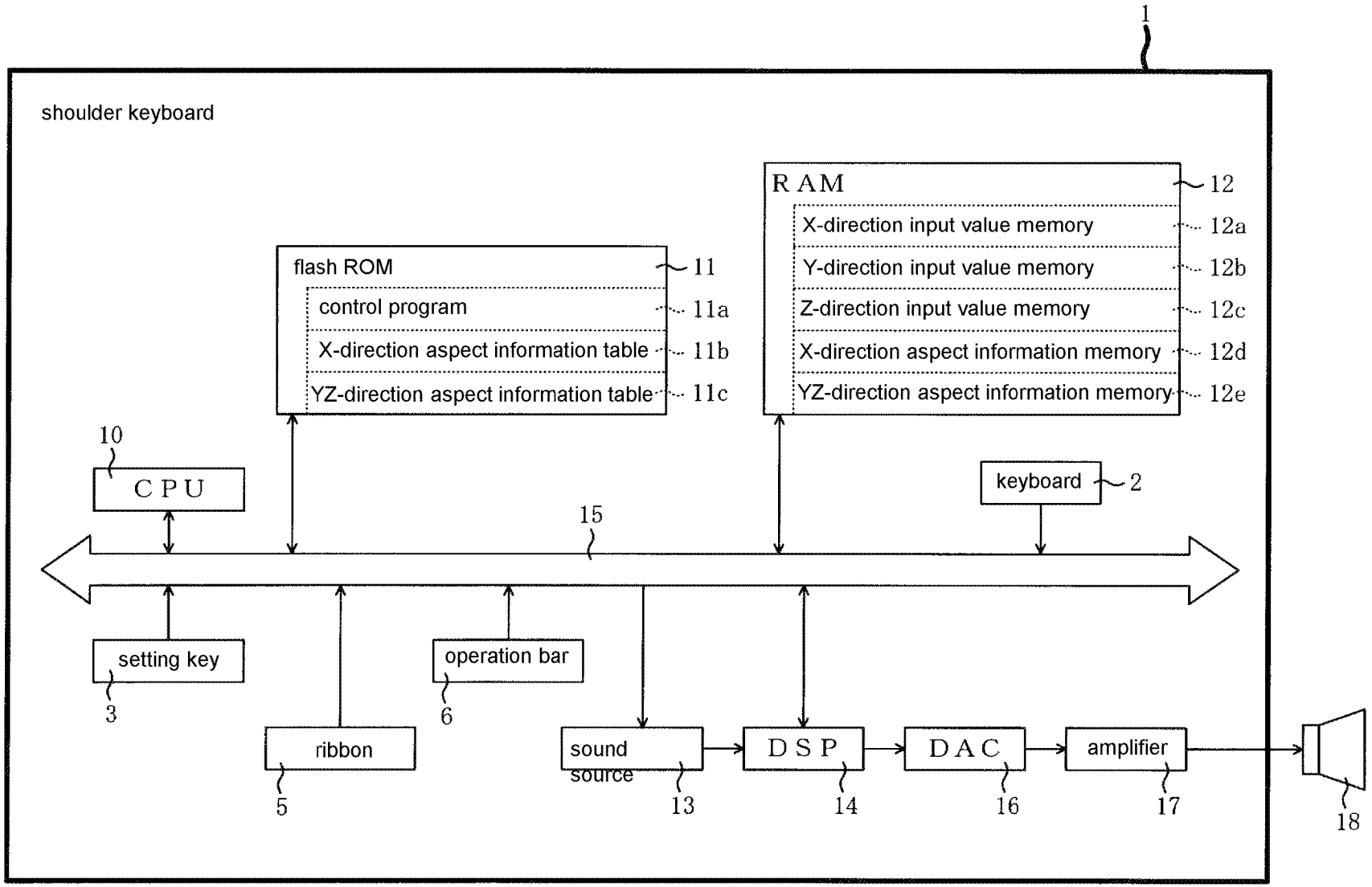
FIG. 11 is a block diagram showing an electrical configuration of the keytar.
Figure 13A:
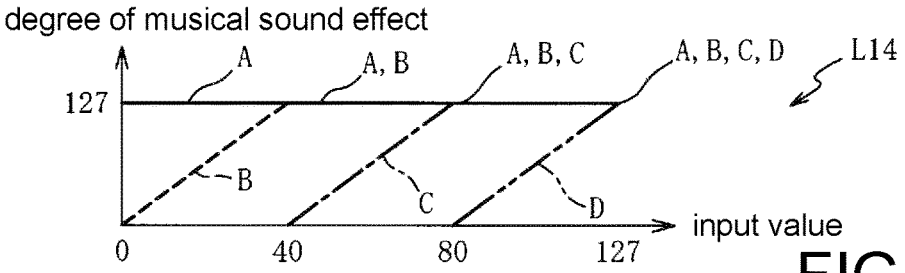
FIG. 13(*a*)-FIG. 13(*f*) are graphs respectively showing an aspect of a change of the degree of a musical sound effect.
Figure 13B:
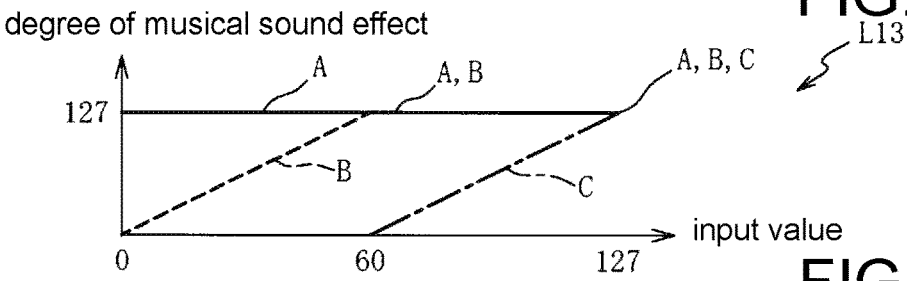
Figure 13C:
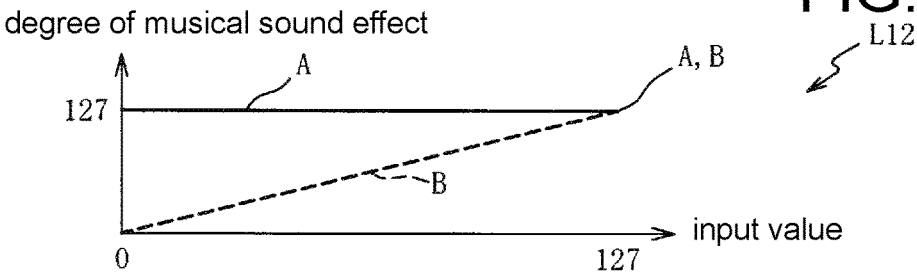
Figure 13D:
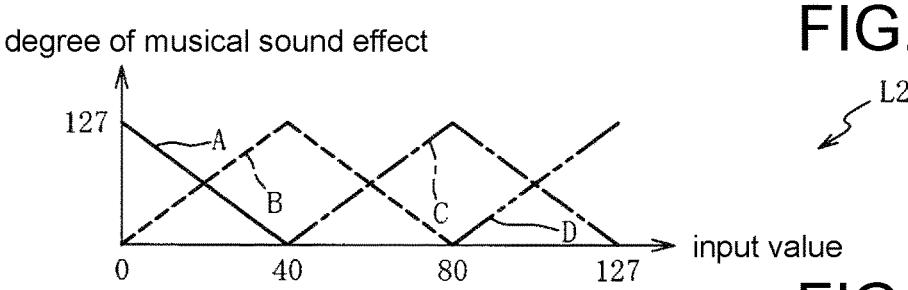
Figure 13E:
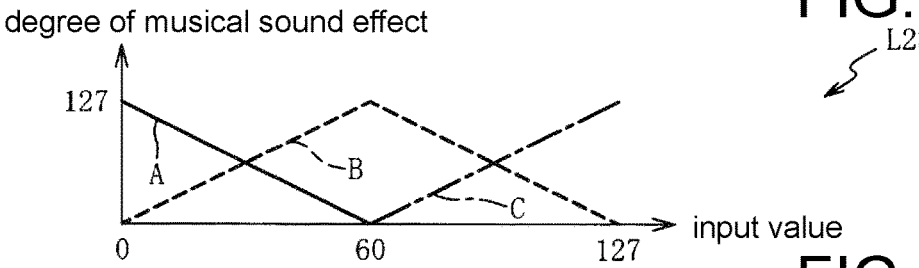
Figure 13F:
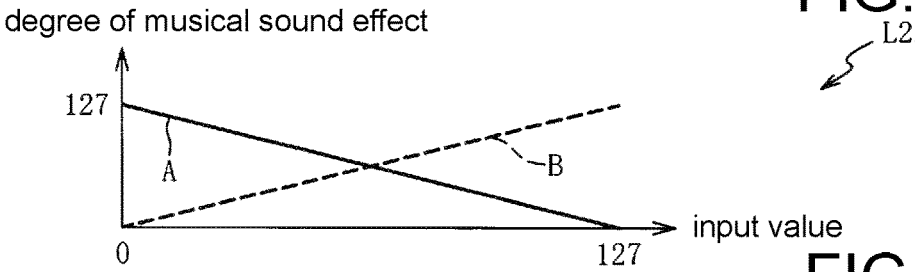

The aspect information storage unit 25 has a function for storing aspect information representing a change of the degree of the musical sound effect applied to each tone corresponding to the detection positions detected by the detection unit 22, and is implemented by an X-direction aspect information table 11*b* described later in FIG. 11 and FIG. 12(*a*). The aspect selection unit 26 has a function for selecting the aspect information stored in the aspect information storage unit 25 and is implemented by the CPU 11. The tone selection unit 27 has a function for selecting a plurality of tones which are objects of the sound instruction obtained by one input of the input unit 20 and is implemented by the CPU 11.

From the above, by the musical sound control unit 21, a plurality of tones which is selected by the tone selection unit 27 and which is based on the sound instruction obtained by one input of the input unit 20 is output after the musical sound effects are applied to the plurality of tones. At this time, the musical sound effect change unit 24 changes, for each tone, the degrees of the musical sound effects respectively assigned corresponding to the detection positions and the pressing force of the detection unit 22 or the operation amount of the operator 23. Accordingly, an expressive performance rich in change of the degree of the musical sound effect for each tone can be achieved.

Particularly, the change of the degree of the musical sound effect for each tone corresponding to the detection positions detected by detection unit 22 is stored in the aspect information storage unit 25, and is performed based on the aspect information selected by the aspect selection unit 26. Accordingly, the degree of the musical sound effect can be changed appropriately according to the aspect information suitable for the preference of the performer H or the genre or tune of a song to be played.

Next, an electrical configuration of the keytar 1 is described with reference to FIG. 11 to FIG. 13(*a*)-FIG. 13(*f*). FIG. 11 is a block diagram showing the electrical configuration of the keytar 1. The keytar 1 has a CPU 10, a flash ROM 11, a RAM 12, a keyboard 2, a setting key 3, a ribbon 5, an operation bar 6, a sound source 13, and a Digital Signal Processor 14 (hereinafter referred to as "DSP 14"), which are respectively connected via a bus line 15. A digital analog converter (DAC) 16 is connected to the DSP 14, an amplifier 17 is connected to the DAC16, and a speaker 18 is connected to the amplifier 17.

Figure 14:
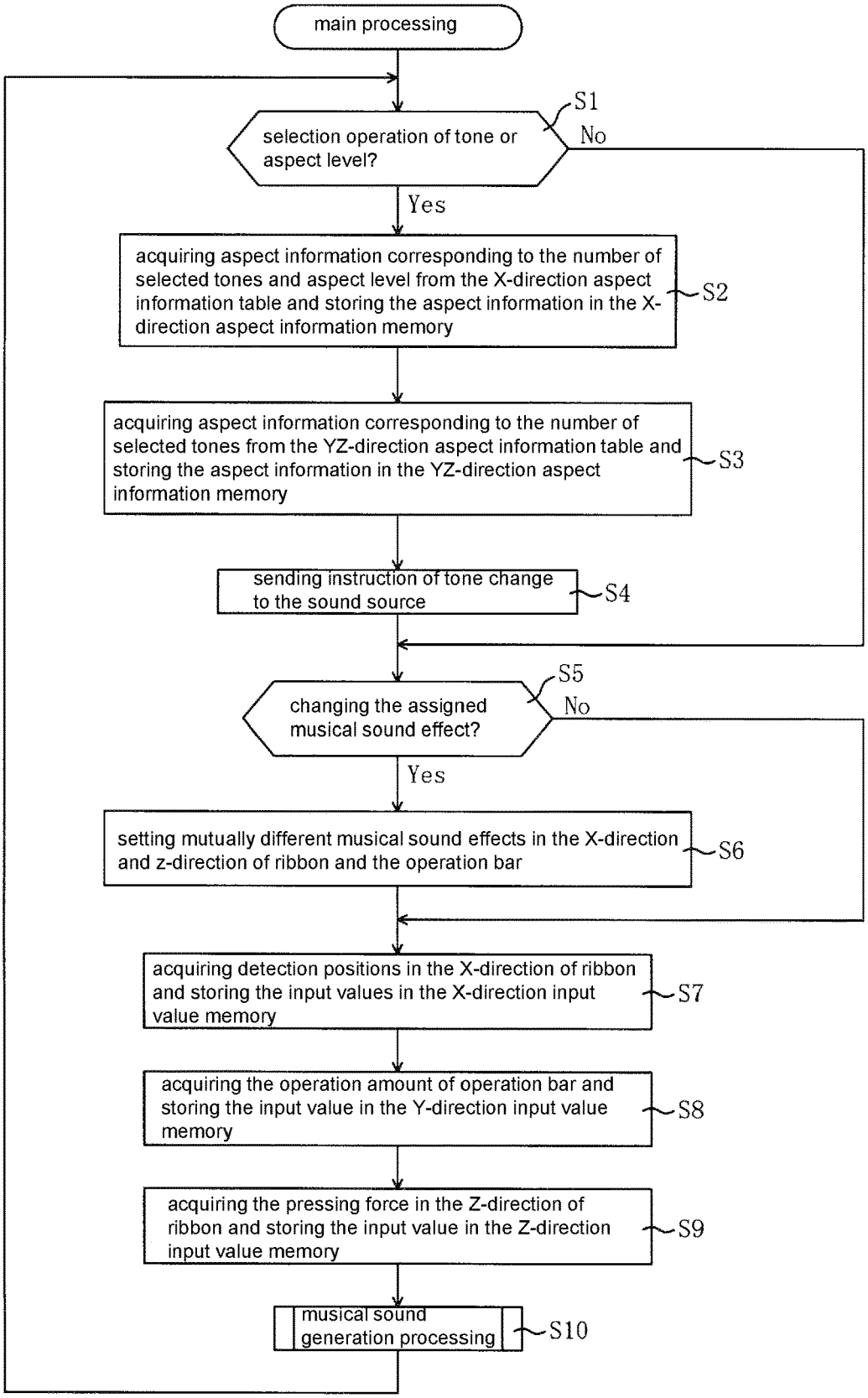
FIG. 14 is a flow chart of main processing.

The CPU 10 is an arithmetic device for controlling each portion connected by the bus line 15. The flash ROM 11 is a rewritable non-volatile memory and is equipped with a control program 11*a*, an X-direction aspect information table 11*b*, and an YZ-direction aspect information table 11*c*. When the control program 11*a* is executed by the CPU 10, the main processing of FIG. 14 is executed. The X-direction aspect information table 11*b* is a data table in which the aspect of the change of the degrees of the musical sound effects assigned to the detection positions in the X-direction of the ribbon 5 is stored. The X-direction aspect information table 11*b* is described with reference to FIG. 12(*a*)-FIG. 12(*d*) and FIG. 13(*a*)-FIG. 13(*f*).

FIG. 12(*a*) is a diagram schematically showing the X-direction aspect information table 11*b*. In the X-direction aspect information table 11*b*, the aspect information associated with an aspect level representing an aspect type of the change of the degree of the musical sound effect and associated with each number of the tones which are sound production objects of one key 2*a* (see FIG. 1) of the keyboard 2 is stored. In the embodiment, there are at most four tones which are the sound production objects of one key 2*a*, and thus the aspect information is stored for each of the sound production numbers of two to four which is the number of the tones produced at the same time. The X-direction aspect information table 11*b* is an example of the aspect information storage unit 25 in FIG. 10.

As shown in FIG. 12(*a*), in an aspect level 1 of the aspect level, aspect information L14 being the aspect information in which the sound production number is four, aspect information L13 being the aspect information in which the sound production number is three, and aspect information L12 being the aspect information in which the sound production number is two are respectively stored in the X-direction aspect information table 11*b*. Similarly, the aspect information after an aspect level 2 is also stored in the X-direction aspect information table 11*b*. Herein, with reference to FIG. 12(*b*), the aspect information stored in the X-direction aspect information table 11*b* is described using the aspect information L14 as an example.

FIG. 12(*b*) is a diagram schematically showing the aspect information L14 stored in the X-direction aspect information table 11*b*. The aspect information is data in which the degree of the musical sound effect for each of tone A-tone D which are four tones corresponding to input values based on the detection positions in the X-direction of the ribbon 5 is stored. In the aspect information L14, the degree of the musical sound effect for each of the tone A-tone D which are four tones corresponding to the input values based on the detection positions in the X-direction of the ribbon 5 is stored.

The input values are values obtained by converting the detection positions in the X-direction detected by the ribbon 5 into numbers of 0-127. Specifically, in regard to the input value, when the position of one end (for example, the left end in a front view) in the X-direction of the front surface panel 81 of the ribbon 5 in FIG. 2(*a*) is set as "0" and the position at the other end is set as "127", a distance from the position at one end to the position at the other end on the X-direction side of the front surface panel 81 is divided into 128 at equal intervals, and each detection position is expressed as an integer of 0-127. That is, values of 0-127 which correspond to the detection positions in the X-direction of the front surface panel 81 specified by the finger of the performer H are acquired as the input values.

The degree of the musical sound effect with respect to the input value is also set to "0" as the minimum value and "127" as the maximum value, and the degrees are set as integers equally divided into 128. That is, the assigned musical sound effect is not applied when the degree of the musical sound effect is 0, while the musical sound effect is applied to the fullest when the degree of the musical sound effect is 127.

Then, the degree of the musical sound effect for each of the tone A-tone D corresponding to the input values based on the detection positions in the X-direction of the front surface panel 81 of the ribbon 5 is acquired from the aspect information L14 and applied to the musical sound effect which is assigned to the X-direction of the front surface panel 81. For example, when the aspect information L14 is specified, "volume" is assigned as a musical sound effect in the X-direction of the front surface panel 81, and the input value based on the detection position in the X-direction of the front surface panel 81 is "41", as shown in FIG. 12(*b*), the "volume" for tone A is set to "127", the "volume" for tone B is set to "127", the "volume" for tone C is set to "3", and the "volume" for tone D is set to "0".

In the embodiment, the degree of the musical sound effect stored in the aspect information L14 and the like is not applied only to a case when the musical sound effect is the "volume", but applied in common to a setting of the degree of other musical sound effects such as pitch change or resonance, cut-off and the like. Accordingly, it is unnecessary to respectively prepare the aspect information L14 and the like for the types of the musical sound effect and thus memory resource can be saved. In the X-direction aspect information table 11*b* of FIG. 12(*a*), the aspect information L14 and the like is stored in each aspect level representing the aspect type of the change of the degree of the musical sound effect. Herein, the aspect type of the change of the degree of the musical sound effect is described with reference to FIG. 13 (*a*)-FIG. 13(*f*).

FIG. 13(*a*)-FIG. 13(*f*) are graphs respectively showing the aspect of the change of the degree of the musical sound effect. In FIG. 13(*a*)-FIG. 13(*f*), the horizontal axis represents the input values and the vertical axis represents the degrees of the musical sound effects with respect to the input values.

FIG. 13(*a*)-FIG. 13(*c*) respectively show the aspect of the change of the degree of the musical sound effect for the aspect information L14-L12 in the aspect level 1 of FIG. 12(*a*). In the aspect information L14 in which four tones are produced, for the tone A, the degree of the musical sound effect remains the maximum value of 127 across the input value of 0-127; for the tone B, the degree of the musical sound effect is increased by a linear function from 0 to 127 when the input value is 0-40, and the degree of the musical sound effect remains 127 when the input value is 41 or more. For the tone C, the degree of the musical sound effect is 0 when the input value is 0-40 while the degree of the musical sound effect is increased by a linear function from 0 to 127 when the input value is 41-80, and the degree of the musical sound effect remains 127 when the input value is 81 or more. For the tone D, the degree of the musical sound effect is 0 when the input value is 0-80 while the degree of the musical sound effect is increased by a linear function from 0 to 127 when the input value is 81-127.

In the aspect information L14, by changing the degree of the musical sound effect in this way, the musical sound effects assigned to the detection positions in the X-direction are only applied to the tone A when the input value is 0; the musical sound effects assigned to the detection positions in the X-direction are only applied to the tones A, B when the input value is 1-40; the musical sound effects assigned to the detection positions in the X-direction are only applied to the tones A, B, C when the input value is 41-80; and the musical sound effects assigned to the detection positions in the X-direction are applied to all the tones A-D when the input value is 81 or more. Accordingly, according to the detection positions in the X-direction specified by the performer H toward the front surface panel 81 of the ribbon 5, the number of tones A-D to which the musical sound effects assigned to the detection positions in the X-direction are applied can be switched rapidly.

Furthermore, if the performer H continuously specifies by sliding the finger from one end side to the other end side (that is, from the input value of 0 to the input value of 127) in the X-direction of the front surface panel 81, the musical sound effect can be applied to overlay the tones A-D in order. In addition, because the degrees of the musical sound effects of the tones A-D are increased by a linear function corresponding to the change of the input value, for at least one of the degrees of the musical sound effects of the tones A-D, the change of this degree of the musical sound effect always rises to the right. Accordingly, any one of the degrees of the musical sound effects of the tones A-D is always increased when the degree of the musical sound effect is continuously changed from one end side to the other end side in the X-direction of the front surface panel 81. Accordingly, a musical sound rich in dynamic feeling (excitement feeling) obtained by the musical sound effect can be produced.

On the other hand, if the performer H continuously specifies from the other end side to one end side (that is, from the input value of 127 to the input value of 0) in the X-direction of the front surface panel 81, the musical sound effects of the tones A-D that are applied can be released in order. Accordingly, by continuously specifying the front surface panel 81, an expressive performance rich in change of the degrees of the musical sound effects of the tones A-D can be achieved.

In addition, the aspect information L13 shown in FIG. 13(*b*) in which three tones are produced or the aspect information L12 shown in FIG. 13(*c*) in which two tones are produced in the same aspect level 1 is also changed in the degrees of the musical sound effects with respect to the tones A-C or the tones A, B in accordance with the above-described aspect information L14. Accordingly, in the same aspect level 1, even if the number of tones which are the sound production objects of one key 2*a* during performance is decreased from four to three or two, a feeling of strangeness of the performer H or the audience on the change of the degree of the musical sound effect can be suppressed to the minimum.

Next, an aspect level 2 which is an aspect level different from the aspect level 1 is described with reference to FIG. 13(*d*)-FIG. 13(*f*). FIG. 13(*d*)-FIG. 13(*f*) respectively show the aspect of the change of the degree of the musical sound effect for the aspect information L24-L22 in the aspect level 2 of FIG. 12(*a*).

As shown in FIG. 13(*d*), in the aspect information L24 in which four tones are produced, for the tone A, the degree of the musical sound effect is decreased by a linear function from 127 to 0 when the input value is 0-40, and the degree of the musical sound effect remains 0 when the input value is 41 or more. For the tone B, the degree of the musical sound effect is increased by a linear function from 0 to 127 when the input value is 0-40, the degree of the musical sound effect is decreased by a linear function from 127 to 0 when the input value is 41-80, and the degree of the musical sound effect remains 0 when the input value is 81 or more. For the tone C, the degree of the musical sound effect remains 0 when the input value is 0-40, the degree of the musical sound effect is increased by a linear function from 0 to 127 when the input value is 41-80, and the degree of the musical sound effect is decreased by a linear function from 127 to 0 when the input value is 80-127. For the tone D, the degree of the musical sound effect remains 0 when the input value is 0-80, and the degree of the musical sound effect is increased by a linear function from 0 to 127 when the input value is 81-127.

In the aspect information L24, by changing the degree of the musical sound effect in this way, when the input values are 0, 40, 80, 127, the degree of the musical sound effect with respect to only one tone within the tones A, B, C, D becomes the maximum value of 127 and the degrees of the musical sound effects with respect to the other tones become 0. Accordingly, by specifying the detection positions in the X-direction corresponding to the input values of 0, 40, 80, 127, the musical sound effects assigned to the detection positions in the X-direction can be applied to only one tone.

In addition, the musical sound effects assigned to the detection positions in the X-direction are only applied to the tones A, B when the input value is 1-40; the musical sound effects assigned to the detection positions in the X-direction are applied to the tones B, C when the input value is 41-80; and the musical sound effects assigned to the detection positions in the X-direction are applied to the tones C, D when the input value is 81 or more. That is, the degrees of the musical sound effects with respect to only two tones within the four tones can be set finely.

In addition, for example, a volume change is set in the tone effect for the detection position in the X direction, a clear guitar sound is set in the tone A, and tones with a strong distortion are set in the tones B-D in the order of tone B→tone C→tone D. If the performer H continuously specifies from one end side to the other end side in the X-direction of the front surface panel 81, a distortion condition of the produced musical sound can be increased gradually; on the other hand, if the performer H discretely specifies the position in the X-direction of the front surface panel 81, the musical sound of the distortion condition corresponding to this position can be produced.

In addition, similar to the aspect level 1, the aspect information L23 shown in FIG. 13(*e*) in which three tones are produced or the aspect information L22 shown in FIG. 13(*f*) in which two tones are produced is also changed in the degrees of the musical sound effects with respect to the tones A-C or the tones A, B in accordance with the above-described aspect information L24.

In this way, the aspect information of a plurality of aspect levels is stored in the X-direction aspect information table 11*b*, and thus an aspect level suitable for the preference of the performer H or the genre or tune of a song to be played can be selected from the plurality of aspect levels, and the degree of the musical sound effect can be changed appropriately. In addition, the change of the degree of the musical sound effect can be switched in various ways by switching the aspect level during performance, and thus an expressive performance can be achieved.

Return to FIG. 11. The YZ-direction aspect information table 11*c* is a data table in which the change aspect of the degree of the musical sound effect assigned to the operation amount in the Y-direction of the operation bar 6 or the pressing force in the Z-direction of the ribbon 5 is stored. The YZ-direction aspect information table 11*c* is described with reference to FIG. 12(*c*) and FIG. 12(*d*).

FIG. 12(*c*) is a diagram schematically showing the YZ-direction aspect information table 11*c*; and FIG. 12(*d*) is a diagram schematically showing aspect information L4 stored in the YZ-direction aspect information table 11*c*. The YZ-direction aspect information table 11*c* is stored corresponding to the number of tones which are the sound production objects of one key 2*a* of the keyboard 2, the aspect information L4 is stored as the aspect information with a sound production number of four in the YZ-direction aspect information table 11*c*; similarly, aspect information L3 is stored as the aspect information with a sound production number of three and aspect information L2 is stored as the aspect information with a sound production number of two in the YZ-direction aspect information table 11*c*. Only the aspect information of one aspect level is stored in the YZ-direction aspect information table 11*c*.

As shown in FIG. 12(*d*), in the aspect information L14, the degree of the musical sound effect with respect to each of the tone A-tone D which are four tones corresponding to the input values based on the operation amount in the Y-direction of the operation bar 6 or the pressing force in the Z-direction of the ribbon 5 is stored. The input values here are also values which are obtained by converting the operation amount in the Y-direction of the operation bar 6 or the pressing force in the Z-direction of the ribbon 5 into 0-127.

In the embodiment, the input value for the operation amount in the Y-direction of the operation bar 6 is set to "0" in a state that the operation bar 6 is separated from the performer H, and is set to "127" in a state that the operation bar 6 is reclined toward the ribbon 5 side as much as possible, and thereby the operation amount is expressed as the integers equally divided into 128. In addition, the input value for the pressing force in the Z-direction of the ribbon 5 is set to "0" in a state that the pressing force is not loaded, and is set to "127" in a state that the maximum pressing force that can be detected by the ribbon 5 is applied, and thereby the pressing force is expressed as the integers equally divided into 128.

As shown in FIG. 12(*d*), in the aspect information L4, the degrees of the musical sound effects of the tones A-D are increased by a linear function from 0 to 127 with respect to the input values 0-127 according to the operation amount in the Y-direction of the operation bar 6 or the pressing force in the Z-direction of the ribbon 5. In addition, although not shown, the aspect information L3 or the aspect information L2 is also changed in the degrees of the musical sound effects with respect to the tones A-C or the tones A, B in accordance with the above-described aspect information L4.

In this way, in the embodiment, only the aspect information of one aspect level is stored in the YZ-direction aspect information table 11*c*, and the aspect information is also set as so-called simple aspect information in which the degrees of the musical sound effects of the tones A-D are increased by a linear function with respect to the input values. The reason is that compared with the detection positions in the X-direction of the front surface panel 81 of the ribbon 5, the operation amount in the Y-direction of the operation bar or the pressing force toward the Z-direction of the front surface panel 81 is hard for the performer H to know how much the operation amount or the pressing force is added; moreover, when the degree of the musical sound effect is changed complicatedly according to a plurality of aspect information with respect to the operation amount in the Y-direction of the operation bar 6 or the Z-direction of the front surface panel 81, it is even harder to know the aspect of this change.

Therefore, by changing the degree of the musical sound effect assigned to the operation amount in the Y-direction of the operation bar 6 or the pressing force in the Z-direction of the ribbon 5 according to one simple aspect information, the performer H easily grasps the change of the degree of the musical sound effect, and thus operability of the keytar 1 can be improved. On the other hand, if the musical sound effects in which complicate change of the degrees is intended are assigned to the detection positions in the X-direction of the ribbon 5, as in the above-described aspect information L14 and the like, the degrees of the musical sound effects with respect to the tones A-D can be changed finely. In addition, by appropriately switching the musical sound effects assigned to the detection positions in the X-direction of the ribbon 5, the operation amount in the Y-direction of the operation bar 6, and the pressing force in the Z-direction of the ribbon 5, the change of the degrees of the musical sound effects can be switched flexibly corresponding to the preference of the performer H.

Return to FIG. 11. The RAM 12 is a memory which rewritably stores various work data, flags or the like when the CPU 10 executes programs such as the control program 11*a* and the like, and the RAM 12 has an X-direction input value memory 12*a* in which the input values converted from the detection positions from the front surface panel 81 of the above-described ribbon 5 are stored, a Y-direction input value memory 12*b* in which the input values converted from the operation amount in the Y-direction of the operation bar 6 are stored, a Z-direction input value memory 12*c* in which the input values converted from the pressing force applied to the front surface panel 81 are stored, an X-direction aspect information memory 12*d* in which the aspect information selected from the X-direction aspect information table 11*b* by the performer H is stored, and a YZ-direction aspect information memory 12*e* in which the aspect information selected from the YZ-direction aspect information table 11*c* by the performer H is stored.

The sound source 13 is a device which outputs waveform data corresponding to performance information input from the CPU 10. The DSP 14 is an arithmetic device for performing an arithmetic processing on the waveform data input from the sound source 13. The DAC 16 is a conversion device which converts the waveform data input from the DSP 14 into analog waveform data. The amplifier 17 is an amplification device which amplifies the analog waveform data output from the DAC 16 with a predetermined gain, and the speaker 18 is an output device which emits (outputs) the analog waveform data amplified by the amplifier 17 as a musical sound.

Next, main processing executed by the CPU 10 is described with reference to FIG. 14 and FIG. 15. FIG. 14 is a flow chart of the main process. The main processing is executed at power-up of the keytar 1.

In the main processing, firstly, a confirmation is made on whether a selection operation of the tone or the aspect level is performed by the setting key 3 (see FIG. 1 and FIG. 11) (S1). Specifically, a confirmation is made on whether the tones with a maximum number of four produced by pressing one key 2*a* is selected from the tones included in the keytar 1 or the aspect level is selected by the performer H via the setting key 3.

When the selection operation of the tones or the aspect level is performed in the processing of S1 (S1: Yes), the aspect information corresponding to the selected number of tones and the selected aspect level is acquired from the X-direction aspect information table 11*b* and stored in the X-direction aspect information memory 12*d* (S2); the aspect information corresponding to the number of tones that is set is acquired from the Y-direction aspect information table 11*c* and stored in the Y-direction aspect information memory 12*e* (S3). At this time, the setting on which tone within the selected tones corresponds to the tones A-D is also performed at the same time. Besides, the CPU 11 executing the processing of S1 is an example of the tone selection unit 27 in FIG. 10, and the CPU 11 executing the processing of S2 is an example of the aspect selection unit 26 in FIG. 10.

Then, after the processing of S3, an instruction of tone change is output to the sound source 13 (S4). On the other hand, in the processing of S1, when the selection operation of the tones is not performed (S1: No), the processing of S2-S4 are skipped.

After the processing of S1 or S4, a confirmation is made on whether the musical sound effects assigned to the detection positions in the X-direction of the ribbon 5, the operation amount in the Y-direction of the operation bar 6 or the pressing force in the Z-direction of the ribbon 5 are changed by the setting key 3 (S5). When the assigned musical sound effects are changed (S5: Yes), mutually different musical sound effects are respectively assigned to the detection positions in the X-direction of the ribbon 5, the operation amount in the Y-direction of the operation bar 6 or the pressing force in the Z-direction of the ribbon 5 (S6). Accordingly, it can be prevented that the same type of musical tone effect is assigned to the detection positions in the X-direction of the ribbon 5, the operation amount in the Y-direction of the operation bar 6 or the pressing force in the Z-direction of the ribbon 5, and thus a feeling of strangeness on the performance of the keytar 1 can be suppressed. On the other hand, in the processing of S5, when the assigned musical sound effects are not changed (S5: No), the processing of S6 is skipped.

After the processing of S5 or S6, the detection positions in the X-direction of the ribbon 5 are acquired, and the detection positions in the X-direction converted into the input values are stored in the X-direction input value memory 12*a* (S7); the operation amount in the Y-direction of the operation bar 6 is acquired, and the operation amount in the Y-direction converted into the input values is stored in the Y-direction input value memory 12*b* (S8); the pressing force in the Z-direction from the ribbon 5 is acquired, and the pressing force in the Z-direction converted into the input values is stored in the Z-direction input value memory 12*c* (S9).

After the processing of S9, musical sound generation processing is executed (S10). Herein, the musical sound generation processing is described with reference to FIG. 15.

Figure 15:
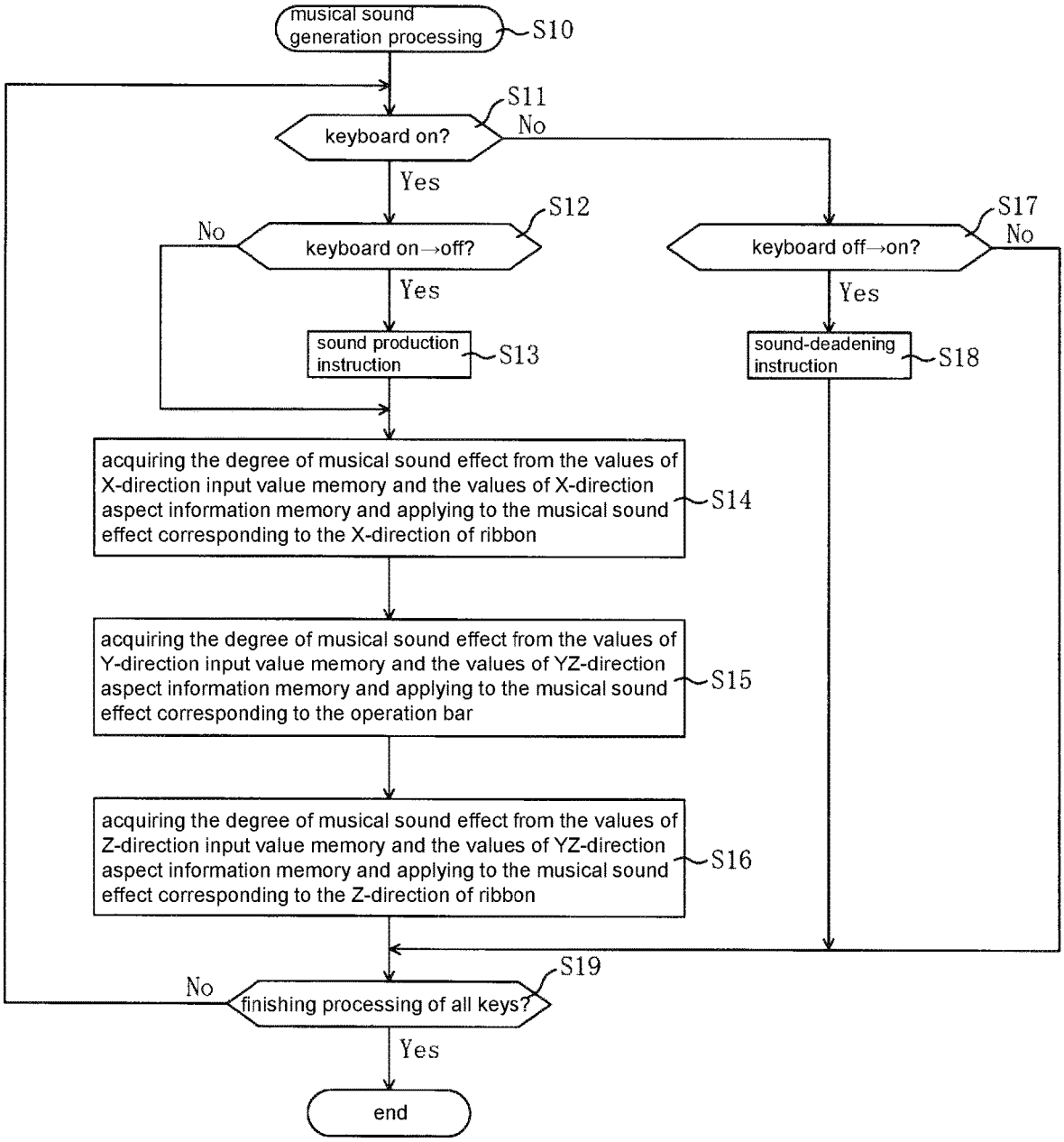
FIG. 15 is a flow chart of a musical sound generation process.

FIG. 15 is a flow chart of the musical sound generation processing. In the musical sound generation processing, firstly, a confirmation is made on whether the keys 2*a* of the keyboard are turned on (S11). Specifically, a confirmation is made on whether all the keys 2*a* of the keyboard 2 are turned on one by one. In the following processing S12 to S18, sound production, sound-deadening or change processing of the degree of the musical sound effect for one key 2*a* is also performed.

When the keys 2*a* of the keyboard 2 are turned on in the processing of S11 (S11: Yes), a confirmation is made on whether the keys 2*a* of the keyboard 2 are changed from turn-off to turn-on (S12). Specifically, a confirmation is made on whether the same key 2*a* which is off in the last musical sound generation processing is turned on in the present musical sound generation processing.

When the keys 2*a* of the keyboard 2 are changed from turn-off to turn-on (S12: Yes), an instruction for producing the tones selected in the processing of S1 and S4 of FIG. 14 according to pitches corresponding to the keys 2*a* is performed on the sound source 13 (S13). At this time, the musical sound effects assigned to the detection position in the X-direction of the ribbon 5, the operation amount in the Y-direction of the operation bar 6, and the pressing force in the Z-direction of the ribbon 5 are also applied to the tones and are output. The CPU 11 executing the processing of S13 is an example of the musical sound control unit 21 in FIG. 10. On the other hand, when the keys 2*a* of the keyboard are not changed from turn-off to turn-on, the corresponding sound production instruction of the keys 2*a* is already output and thus the processing of S13 is skipped.

After the processing of S12 or S13, the degrees of respective musical sound effects assigned to the detection positions in the X-direction of the ribbon 5, the operation amount in the Y-direction of the operation bar 6, and the pressing force in the Z-direction of the ribbon 5 are changed. Specifically, after the processing of S12 or S13, the degrees of the musical sound effects of respective tones in the aspect information of the X-direction aspect information memory 12*d* corresponding to the input values stored in the X-direction input value memory 12*a* are acquired, and are respectively applied to the degrees of the musical sound effects assigned to the detection positions in the X-direction of the ribbon 5 (S14). The CPU 11 executing the processing of S14 is an example of the musical sound effect change unit 24 in FIG. 10.

After the processing of S14, the degrees of the musical sound effects of respective tones in the aspect information of the YZ-direction aspect information memory 12*d* corresponding to the input values for the operation amount in the Y-direction of the operation bar 6 are acquired, and are respectively applied to the degree of the musical sound effect assigned to the operation amount in the Y-direction of the operation bar 6 (S15); the degrees of the musical sound effects of respective tones in the aspect information of the YZ-direction aspect information memory 12*d* corresponding to the input values for the pressing force in the Z-direction of the ribbon 5 are acquired, and are respectively applied to the degree of the musical sound effect assigned to the pressing force in the Z-direction of the ribbon 5 (S16).

That is, by the processing of S14-S16, the degrees of the musical sound effects assigned to the detection positions in the X-direction of the ribbon 5, the operation amount in the Y-direction of the operation bar 6 and the pressing force in the Z-direction of the ribbon 5 can be changed based on the input value which is based on each detection position, the operation amount in the Y-direction, and the pressing force. Particularly, in the musical sound effects assigned to the detection positions in the X-direction of the ribbon 5, as described above in FIG. 13(*a*)-FIG. 13(*f*), the aspect information of a plurality of aspect levels can be applied. Accordingly, the change of the degrees of the musical sound effects assigned to the detection positions in the X-direction of the ribbon 5 can be switched in various ways by appropriately switching the aspect levels during performance, and thus an expressive performance in which the monotony of the degree of the musical sound effect is suppressed can be achieved.

When the keys 2*a* of the keyboard are turned off in the processing of S11 (S11: No), a confirmation is made on whether the keys 2*a* of the keyboard 2 are changed from turn-on to turn-off (S17). Specifically, a confirmation is made on whether the same key 2*a* which is on in the last musical sound generation processing is turned off in the present musical sound generation processing.

When the keys 2*a* of the keyboard 2 are changed from turn-on to turn-off (S17: Yes), an instruction for sound-deadening the tones corresponding to the keys 2*a* is performed on the sound source 13 (S18). On the other hand, when the keys 2*a* of the keyboard 2 are not changed from turn-on to turn-off, the corresponding sound-deadening instruction of the keys 2*a* is already output and thus the processing of S18 is skipped.

After the processing of S16-S18, a confirmation is made on whether the processing of S11-S18 is completely performed on all the keys 2*a* of the keyboard 2 (S19); when the processing is not completed, the processing of S11-S18 is performed on the keys 2*a* other than the keys 2*a* on which the processing of S11-S18 are already performed. On the other hand, when the processing of S11-S18 is completely performed on all the keys 2*a* of the keyboard 2 (S19: Yes), the musical sound generation processing is ended, and the processing returns to the main processing of FIG. 14.

Return to FIG. 14. After the musical sound generation processing of S10 is ended, the processing after S1 is repeated.

A description is given above based on the above-described embodiments, but it can be easily inferred that various improvements and changes can be made.

In the above-described embodiments, the keytar 1 is illustrated as the electronic musical instrument. However, the disclosure is not limited hereto and may be applied to other electronic musical instruments such as an electronic organ, an electronic piano or the like in which a plurality of musical sound effects are applied to the tones that are produced. In this case, it is sufficient if the ribbon 5 and the operation bar 6 are arranged on the electronic musical instrument.

In the above-described embodiments, according to the aspect information stored in the X-direction aspect information table 11*b* and the YZ-direction aspect information table 11*c*, the degrees of all the musical sound effects are changed. However, the disclosure is not limited hereto, and the degrees of the musical sound effects may be changed according to different aspect information in the musical sound effects. In this case, the X-direction aspect information table 11*b* and the YZ-direction aspect information table 11*c* may be arranged for each musical sound effect, and the aspect information corresponding to the musical sound effects assigned to the detection positions in the X-direction, the operation amount in the Y-direction or the pressing force in the Z-direction is acquired from each of the X-direction aspect information table 11*b* and YZ-direction aspect information table 11*c*.

In the above-described embodiments, one musical sound effect is assigned to the detection positions in the X-direction of the ribbon 5 in the processing of S6 in FIG. 14; by the processing of S14 in FIG. 15, the degrees of the musical sound effects of the respective tones A-D in the aspect information of the X-direction aspect information memory 12*d* are acquired, and are respectively applied to the degrees of the musical sound effects assigned to the detection positions in the X-direction of the ribbon 5. However, the disclosure is not limited hereto, and a plurality of musical sound effects may be assigned to the detection positions in the X-direction of the ribbon 5, furthermore, the musical sound effect applied to each of the tones A-D may be assigned from the plurality of musical sound effects, and the degrees of the musical sound effects of the respective tones A-D in the aspect information of the X-direction aspect information memory 12*d* may be acquired and respectively applied to the degrees of the musical sound effects assigned to the tones A-D.

For example, the musical sound effects of volume change, pitch change, cut-off, and resonance may be respectively assigned to the detection positions in the X-direction of the ribbon 5; furthermore, from the musical sound effects, the volume change may be assigned to the tone A, the pitch change may be assigned to the tone B, the cut-off may be assigned to the tone C, and the resonance may be assigned to the tone D to acquire the degree of the musical sound effect of each of the tones A-D in the aspect information of the X-direction aspect information memory 12*d* and apply the acquired degree of the musical sound effect with respect to the tone A to the degree of the volume change assigned to the tone A, and the degrees of the musical sound effects with respect to the tones B-D acquired similarly are applied to the respective degrees of the pitch change, the cut-off, and the resonance assigned to the tones B-D.

With this configuration, the degrees of the plurality of musical sound effects assigned to the respective tones A-D can be changed corresponding to the detection positions in the X-direction of the ribbon 5, and thus a performance having a high degree of freedom can be achieved. In addition, because the degrees of the plurality of musical sound effects are changed according to the same aspect information, the degrees of the plurality of musical sound effects are respectively changed in a similar aspect corresponding to the detection positions in the X-direction of the ribbon 5. Accordingly, an expressive performance which gives regularity to the changes of the plurality of different musical sound effects can be achieved.

In the above-described embodiments, in the processing of S6 in FIG. 14, mutually different musical sound effects are respectively assigned to the detection positions in the X-direction of the ribbon 5, the operation amount in the Y-direction of the operation bar 6 or the pressing force in the Z-direction of the ribbon 5. However, the disclosure is not limited hereto, and the same musical sound effect may be assigned to all of the detection positions in the X-direction of the ribbon 5, the operation amount in the Y-direction of the operation bar 6, and the pressing force in the Z-direction of the ribbon 5. In addition, the same musical sound effect may be assigned to the detection positions in the X-direction of the ribbon 5 and the operation amount in the Y-direction of the operation bar 6, and a different musical sound effect may be assigned to the pressing force in the Z-direction of the ribbon 5; alternatively, the same musical sound effect may be assigned to the detection positions in the X-direction of the ribbon 5 and the pressing force in the Z-direction of the ribbon 5, and a different musical sound effect may be assigned to the operation amount in the Y-direction of the operation bar 6; alternatively, the same musical sound effect may be assigned to the operation amount in the Y-direction of the operation bar 6 and the pressing force in the Z-direction of the ribbon 5, and a different musical sound effect may be assigned to the detection positions in the X-direction of the ribbon 5.

For example, the pitch changes are assigned to the musical sound effects of the detection positions in the X-direction of the ribbon 5 and the operation amount in the Y-direction of the operation bar 6, and the resonance is assigned to the musical sound effect of the pressing force in the Z-direction of the ribbon 5. Then, the performer H can achieve a performance in which after the operation bar 6 is operated with the index finger of the left hand to change the pitch continuously, the pitch is changed discretely by specifying the positions of the ribbon 5 with the ring finger of the left hand, and furthermore, the sound production is controlled by a nuance of the resonance corresponding to the pressing force applied to the ribbon 5 with the ring finger of the left hand. Accordingly, by a left-hand operation substantially similar to that of the real guitar, performance expressions unique to guitar playing can be achieved. The performance expressions refer to that, in a performance using a real guitar, in regard to a picked string, a so-called choking performance method for changing the pitch of sound by pulling the string with the index finger of the left hand that presses the string is performed; after that, a so-called hammer-on performance method for strongly pressing (in a beating manner), with the ring finger of the left hand, the other fret on the same string being pressed to produce sound is performed.

In the above-described embodiments, the aspect information corresponding to the aspect level of the X-direction aspect information table 11*b* is set in the musical sound effects for the detection positions in the X-direction, and the aspect information of the YZ-direction aspect information table 11*c* is set in the musical sound effects for the operation amount in the Y-direction and the pressing force in the Z-direction. However, the disclosure is not limited hereto, the aspect information corresponding to the aspect level of the X-direction aspect information table 11*b* may be set in the musical sound effects for the operation amount in the Y-direction and the pressing force in the Z-direction, or the aspect information of the YZ-direction aspect information table 11*c* may be set in the musical sound effects for the detection positions in the X-direction.

For example, the aspect information corresponding to the aspect level of the X-direction aspect information table 11*b* is set in the musical sound effect for the pressing force in the Z-direction, and the aspect level is set to the aspect level 2 and is only set for two tones, namely the tone A and the tone B; furthermore, the musical sound effect for the pressing force in the Z-direction is set to volume change. Accordingly, the volumes of the tone A and the tone B can be changed according to the aspect information L22 (see FIG. 13(*f*)) corresponding to the pressing force in the Z-direction. Furthermore, if the tone A is set as a tone of guitar played using a brushing performance method and the tone B is set as a tone of guitar played by an open string, when the tone of guitar using the open string is to be produced, the ribbon 5 may be pressed strongly to increase the pressing force in the Z-direction; on the other hand, when the tone of guitar using the brushing performance method is to be produced, the ribbon 5 may be pressed gently to reduce the pressing force in the Z-direction of the ribbon 5. Furthermore, if the ribbon 5 is operated with the left hand of the performer H, a performance using the open string and a performance using the brushing performance method can be separated by the left-hand operation substantially similar to that of the real guitar.

In the above-described embodiments, in FIG. 12(*a*)-FIG. 12(*d*) and FIG. 13(*a*)-FIG. 13(*f*), the aspect information is configured to be increased or decreased by a linear function corresponding to the input values. However, the disclosure is not limited hereto, and the aspect information may be increased or decreased in curved shape, for example, by a function represented by polynomial, such as a quadratic function, a cubic function or the like, or by an exponential function corresponding to the input values, or the aspect information may be increased or decreased in step, for example, by a step function with respect to the input values. In addition, the aspect information is not limited to be increased or decreased uniformly in one direction corresponding to the input values, and may be increased or decreased in zigzag shape corresponding to the input values or may be changed quite randomly without being based on the input values.

In the above-described embodiments, the degrees of the assigned musical sound effects are respectively changed according to the detection positions in the X-direction, the operation amount in the Y-direction, and the pressing force in the Z-direction. However, the disclosure is not limited hereto, and other settings may be changed corresponding to the detection position in the X-direction, the operation amount in the Y-direction, and the pressing force in the Z-direction. For example, the type of the musical sound effects assigned to the detection positions in the X-direction or the operation amount in the Y-direction may be changed corresponding to the pressing force in the Z-direction, or the type or the number of the tones assigned to the keys 2*a* may be changed corresponding to the operation amount in the Y-direction.

In the above-described embodiments, the keytar 1 is equipped with the ribbon 5 and the operation bar 6. However, the disclosure is not limited hereto, and the operation bar 6 may be omitted and only the ribbon 5 is arranged on the keytar 1, or the ribbon 5 may be omitted on the keytar 1 and only the operation bar 6 is arranged on the keytar 1. In addition, a plurality of ribbons 5 or operation bars 61 may be arranged on one keytar 1. In this case, different musical sound effects may be assigned to the detection position in the X-direction of the ribbon 5 and the pressing force in the Z-direction or the operation amount in the Y-direction of the operation bar 6 respectively. Furthermore, when a plurality of ribbons 5 are arranged, different aspect levels may be set for the respective detection positions in the X-direction.

In the above-described embodiments, the number of tones which are sound production objects of one key 2*a* is four at most. However, the disclosure is not limited hereto, and the maximum number of tones which are the sound production objects of one key 2*a* may be five or more or be three or less. In this case, the degree of the musical sound effect of the maximum number of the tones which are the sound production objects of one key 2*a* may be stored in the aspect information L14, L4 and the like of FIG. 12(*b*) and FIG. 12(*d*) stored in the X-direction aspect information table 11*b* and the YZ-direction aspect information table 11*c*.

The numerical values mentioned in the above-described embodiments are merely examples, and certainly other numerical values can be adopted.

What is claimed is:

1. An electronic musical instrument, comprising:

an input unit, which inputs a sound instruction of a plurality of tones;

a detection unit, which has a detection surface and detects detection positions on the detection surface;

a musical sound control unit, which applies a musical sound effect to each of the plurality of tones based on the sound instruction input by the input unit and outputs the tones;

a musical sound effect change unit, which changes, for each tone, a degree of the musical sound effect applied to each tone by the musical sound control unit corresponding to the detection positions detected by the detection unit; and an operator which is arranged near the detection unit and inputs an operation of a performer, wherein the musical sound effect change unit changes the degrees of the musical sound effects applied to the plurality of tones output by the musical sound control unit corresponding to the operation on the operator, and wherein the operator is arranged along a longitudinal side of the detection unit, and an operation amount of the operator is output by operating to recline the operator toward an opposite side of the detection unit.

2. The electronic musical instrument according to claim 1, wherein the input unit inputs a sound instruction of a plurality of tones by one input;

the electronic musical instrument comprises a tone selection unit which selects a plurality of tones that is an object of the sound instruction of one input of the input unit; and the musical sound control unit applies, based on the sound instruction of one input of the input unit, a musical sound effect to each of the plurality of tones that is selected by the tone selection unit and outputs the tones.

3. The electronic musical instrument according to claim 1, comprising:

an aspect information storage unit, which stores aspect information representing a change of the degree of the musical sound effect applied to each tone corresponding to the detection positions detected by the detection unit; and an aspect selection unit, which selects the aspect information stored in the aspect information storage unit;

wherein the musical sound effect change unit changes, for each tone, the degree of the musical sound effect applied to each tone corresponding to the detection positions detected by the detection unit based on the aspect information selected by the aspect selection unit.

4. The electronic musical instrument according to claim 1, wherein the musical sound effect change unit changes, for each tone, the degree of the same type of musical sound effect applied to each tone corresponding to the detection positions detected by the detection unit.

5. The electronic musical instrument according to claim 1, wherein the detection unit is capable of detecting a pressing force loaded on the detection surface, and the musical sound effect change unit changes the degrees of the musical sound effects applied to the plurality of tones output by the musical sound control unit corresponding to the pressing force on the detection unit.

6. The electronic musical instrument according to claim 5, wherein the musical sound effect change unit changes, corresponding to the pressing force on the detection unit, the degrees of musical sound effects that are applied to the plurality of tones output by the musical sound control unit and that are different in type from the musical sound effects which are changed corresponding to the detection positions detected by the detection unit.

7. The electronic musical instrument according to claim 1, wherein the musical sound effect change unit changes, corresponding to the operation on the operator, the degrees of musical sound effects that are applied to the plurality of tones output by the musical sound control unit, and that are different in type from the musical sound effects which are changed corresponding to the detection positions detected by the detection unit and the musical sound effects which are changed corresponding to the pressing force on the detection surface.

8. The electronic musical instrument according to claim 1, wherein the detection positions detected by the detection unit are positions on one direction side on the detection surface; and an operation direction of the operator is a direction orthogonal to the direction in which the detection positions are detected by the detection unit and orthogonal to the direction in which the pressing force is detected by the detection unit.

9. An electronic musical instrument, comprising:

an input unit, which inputs a sound instruction of a plurality of tones;

a detection unit, which has a detection surface and detects detection positions on the detection surface;

a musical sound control unit, which applies a musical sound effect to each of the plurality of tones based on the sound instruction input by the input unit and outputs the tones;

a musical sound effect change unit, which changes, for each tone, a degree of the musical sound effect applied to each tone by the musical sound control unit corresponding to the detection positions detected by the detection unit; and an operator which is arranged near the detection unit and inputs an operation of a performer, wherein the musical sound effect change unit changes the degrees of the musical sound effects applied to the plurality of tones output by the musical sound control unit corresponding to the operation on the operator, and wherein the operator is a modulation bar.

10. An electronic musical instrument, comprising:

an input unit, which inputs a sound instruction of a plurality of tones;

a detection unit, which has a detection surface and detects detection positions on the detection surface;

a musical sound control unit, which applies a musical sound effect to each of the plurality of tones based on the sound instruction input by the input unit and outputs the tones; and a musical sound effect change unit, which changes, for each tone, a degree of the musical sound effect applied to each tone by the musical sound control unit corresponding to the detection positions detected by the detection unit, wherein the detection unit is a ribbon controller.

11. The electronic musical instrument according to claim 1, wherein the detection unit has a structure in which a position sensor and a pressure sensitive sensor are formed in a part of a folded sheet.

12. An electronic musical instrument, comprising:

an input unit, which inputs a sound instruction of a plurality of tones;

a detection unit, which has a detection surface and detects detection positions on the detection surface;

a musical sound control unit, which applies a musical sound effect to each of the plurality of tones based on the sound instruction input by the input unit and outputs the tones; and a musical sound effect change unit, which changes, for each tone, a degree of the musical sound effect applied to each tone by the musical sound control unit corresponding to the detection positions detected by the detection unit, wherein the detection unit has a structure in which one base material includes four parts, resistance membranes for position detection are formed on each of a first part and a second part which are two adjacent parts in the four parts, and resistance membranes being pressure sensitive are formed in each of a third part and a fourth part which are the other two adjacent parts of the four parts; the second part is laminated by being folded with respect to the first part, the third part is laminated by being folded with respect to the fourth part, and two parts formed by folding are interfolded.

13. An electronic musical instrument, comprising:

an input unit, which inputs a sound instruction of a plurality of tones;

an operator, which inputs an operation of a performer;

a musical sound control unit, which applies a musical sound effect to each of the plurality of tones based on the sound instruction input by the input unit and outputs the tones; and a musical sound effect change unit, which changes, for each tone, a degree of the musical sound effect applied to each tone by the musical sound control unit corresponding to the operation on the operator.

14. The electronic musical instrument according to claim 13, comprising a tone selection unit, which selects a plurality of tones that is an object of the sound instruction of one input of the input unit;

wherein the musical sound control unit applies, based on the sound instruction of one input of the input unit, a musical sound effect to each of the plurality of tones that is selected by the tone selection unit and outputs the tones.

15. A musical sound generation processing method of electronic musical instrument, which is a musical sound generation processing method of the electronic musical instrument according to claim 1, comprising:

a step for inputting the sound instruction;

a step for detecting the detection positions;

a step for applying the musical sound effect to each of the plurality of tones based on the input sound instruction and outputting the tones;

a step for changing, for each tone, the degrees of the musical sound effects applied to the plurality of tones to be output corresponding to the detected detection positions.

16. A musical sound generation processing method of electronic musical instrument, which is a musical sound generation processing method of the electronic musical instrument according to claim 9, comprising:

a step for inputting the sound instruction;

a step for detecting the detection positions;

a step for applying the musical sound effect to each of the plurality of tones based on the input sound instruction and outputting the tones;

a step for changing, for each tone, the degrees of the musical sound effects applied to the plurality of tones to be output corresponding to the detected detection positions.

17. A musical sound generation processing method of electronic musical instrument, which is a musical sound generation processing method of the electronic musical instrument according to claim 10, comprising:

a step for inputting the sound instruction;

a step for detecting the detection positions;

a step for applying the musical sound effect to each of the plurality of tones based on the input sound instruction and outputting the tones;

a step for changing, for each tone, the degrees of the musical sound effects applied to the plurality of tones to be output corresponding to the detected detection positions.

18. A musical sound generation processing method of electronic musical instrument, which is a musical sound generation processing method of the electronic musical instrument according to claim 13, comprising:

a step for inputting the sound instruction;

a step for detecting detection positions;

a step for applying the musical sound effect to each of the plurality of tones based on the input sound instruction and outputting the tones;

a step for changing, for each tone, the degrees of the musical sound effects applied to the plurality of tones to be output corresponding to the detected detection positions.

* * * * *